United States Patent [19]

Chwae

[11] 4,365,444

[45] Dec. 28, 1982

[54] DRILL POINT GRINDING MACHINE

[76] Inventor: John C. Chwae, c/o Giddings & Lewis, Inc., 142 Doty St., Fond du Lac, Wis. 54935

[21] Appl. No.: 162,547

[22] Filed: Jun. 24, 1980

[51] Int. Cl.[3] ..... B24B 3/26

[52] U.S. Cl. ..... 51/94 R; 51/124 R; 51/267

[58] Field of Search ..... 51/94 R, 95 WH, 124 R, 51/123 R, 267

[56] References Cited

U.S. PATENT DOCUMENTS

| | | | |
|---|---|---|---|
| 3,040,480 | 6/1962 | Winslow et al. | 51/95 W X |
| 3,114,988 | 12/1963 | Garrison | 51/124 R |
| 3,209,493 | 10/1965 | Houser | 51/94 R |
| 3,266,194 | 8/1966 | Winslow | 51/94 R |
| 3,543,445 | 12/1970 | Borchert | 51/124 R |
| 3,543,451 | 12/1970 | Smith | 51/267 |
| 3,712,001 | 1/1973 | Kaesemeyer | 51/267 |
| 4,084,357 | 4/1978 | Moses | 51/426 |

*Primary Examiner*—Harold D. Whitehead

*Attorney, Agent, or Firm*—Leydig, Voit, Osann, Mayer & Holt

[57] ABSTRACT

A drill point grinding machine having a selectively positionable workhead rotatably supporting a drill to be ground and a rotary grinding wheel that is positionable toward and away from the workhead. The machine has a control for selectively moving the workhead such that a drill carried thereby undergoes a first cyclic path of engagement with the grinding wheel for grinding a first drill point form and a second cyclic path of contact with the grinding wheel when a second drill point form is to be ground. The control is further selectively operable for causing the workhead to move a drill successively through said first and second cyclic paths for grinding a third drill point form. The machine control also is adapted to automatically move the workhead in the foregoing manner, as well as automatically advancing the grinding wheel to a position in close proximity to the drill prior to the grinding operation and then automatically feeding the grinding wheel a further predetermined amount during grinding.

50 Claims, 48 Drawing Figures

10
221
229
21
230
222
10
186
14
49
50
55
59
57
293
295
54
12
15
205
188
62
202
201
200
199
32
198
194
255
259
256
254
252
294
258
266
282
288
292
191
265
264
48
250
206
25
246
290
240
310
241
238
64
236
235
271
270
65
48
273
278
276
273
274
274
275
272
285
34
11
45
10

20
345
C-8
348
342
330
62
320
355
344
358
358a
191
340
19
.050
.040
.030
.020
.010
0
LS-15
LS-16
326
332
366
366a
365a
371
362a
365
371a
332
328
362
325
360a
324
C-6
361
C-7
364a
364
360
355
357
C-5
370
370a
371
356
371a
LS-9
LS-10
372
375
355
372a
320
322
322
C-4
321
62
20

DRILL POINT GRINDING MACHINE

DESCRIPTION OF THE INVENTION

The present invention relates generally to grinding machines and more particularly to an improved drill point grinding machine.

Several basic forms of drill points have been developed over the years which each have distinct features and typically have required specifically designed grinding machines for their manufacture and resharpening. The well known "conical" or conventional drill point has a conical configuration with a straight chisel edge at its forwardmost end. In use of such conical drills, however, the straight chisel edge has the disadvantage of contributing to walking of the drill point, and thus, often requires prior use of a centering drill. The conical drill point also defines a sharp angle at the margin of the drill shank, which causes chips to be pushed out of the hole at breakthrough generally producing burrs.

The "helical" drill point, on the other hand, has a generally S or helical shaped crowned chisel edge which provides a self-centering capability not possible with the conical drill point. Because the drill tends to cut a centered hole, helical points also distribute wear more evenly, and thereby extends the life of the drill. Like the conventional point, however, the helical point has a sharp angle where it meets the margin, and thus causes burrs at breakthrough.

The development of a drill point referred to as the radial-conventional or "Racon" drill point, brought additional advantages to drilling. This point is generated by grinding a conventional twist drill to a configuration having a blended, curved shape where the outer of the drill point surface meets the shank. Because the drill cuts along a relatively long curved arc, it better distributes the load along the length of the cutting edge, than the conventional drill point and produces less torque. Drills with this point have been capable of producing up to ten times the number of holes before sharpening as compared to the conventional drill point. Also, because the point is cutting all the way through, it creates little or no burrs at breakthrough. On the negative side, however, the Racon point has a straight chisel edge and is not self-centering, and therefore, usually requires the use of a centering drill.

There recently has been developed another improved drill point, referred to as the helicon, the combination helical and radial-conventional, or the "Bickford" point, which incorporates the advantages of the helical and Racon points, without the disadvantages. The helicon point has both a crowned S-curved chisel edge and a curved margin such that is is both self-centering and has a burr-free breakthrough. Additionally, it has greatly increased tool life and permits greater feed rates in use.

With the development of such drill points, the need arose for developing machines for most efficiently and economically grinding the surfaces of such drill points. Typically machines have been designed for grinding a specific one of the drill points. For example, individualized machines have been developed for machining either the conical, helical, or the Racon drill point in a single setup. This has been achieved in part by developing a mathematical formula for the desired drill point surface in terms of movement of the drill relative to a grinding surface about three coordinate reference axes and then designing a grinding machine to carry out the appropriate motions. Specifically, the surfaces of the conical, helical and Racon drill points have been defined by the formula:

$$\frac{x^2}{a^2} + \frac{y^2}{b^2} + S\frac{z^2}{c^2} = 1$$

x, y, and z representing the three reference axes with its solution (x, y, z) representing a point coordinate, and a, b, and c representing coefficient of movement relative to the respective axes. For defining a helical drill point surface, the constant S equals $-1$; for defining a Racon drill point surface, the constant S equals $+1$; and for defining a conventional drill point, the constant S equals $+1$.

Drill point grinding machines have been developed for moving a drill in accordance with such formula to define a particular diagnosed surface geometry. For example, U.S. Pat. No. 3,209,493, presently assigned to the same assignee as the present application, discloses a machine that can be operated to generate motions pursuant to such formula for grinding either the conical or helical drill points. Similar machines are known for grinding the Racon drill point in a single setup.

With the development of the Bickford drill point, the need arose to develop a machine that also would efficiently and economically grind that form of point. Accordingly, as in the case of the conical, helical and Racon drill points, considerable effort was made to develop a mathematical formula which would provide the basis for generating the surface geometry of such drill point form. After extensive mathematical and computer analyses had been carried out, however, it was ultimately determined that it was not possible to define the helicon drill point in terms of a single formula. Instead, it was found that in the foregoing formula, the constant "S" had to be both a negative number and a positive number, in other words, a mathematical impossibility. As a result, notwithstanding the many advantages of the Bickford type drill point, it heretofore has not been possible to grind such a drill point in a single setup or in a single machine and typically two machines and two distinct grinding operations have been required. Because this requires significant capital expenditure, as well as doubling the machine setup time, the cost of grinding the Bickford point has been relatively high. For the same reasons, it heretofore has not been possible to readily grind both helical and Racon drill points by the same machine, and customarily changeover modifications to the machine are required which take from two to eight hours to effect, thus significantly interrupting the use of the machine.

Accordingly, it is an object of the present invention to provide a drill point grinding machine that is adapted to grind the Bickford type drill point in a single setup.

Another object is to provide a drill point grinding machine as characterized above that is capable of readily grinding conical, helical, and Racon drill points, as well as the Bickford drill point, without significantly interrupting the productive operation of the machine for changeover purposes.

A further object is to provide a drill point grinding machine of the foregoing type that is automatically operable to grind a specifically designated drill point after a single setup. A related object is to provide such a drill point grinding machine that is adapted to automatically control and coordinate movement of both the drill and grinding wheel during a grinding operation.

Yet another object is to provide a drill point grinding machine of the above kind which can accommodate a larger range of drill sizes than heretofore possible.

Other objects and advantages of the invention will become apparent upon reading the following detailed description and upon reference to the drawings in which.

Figure 1:
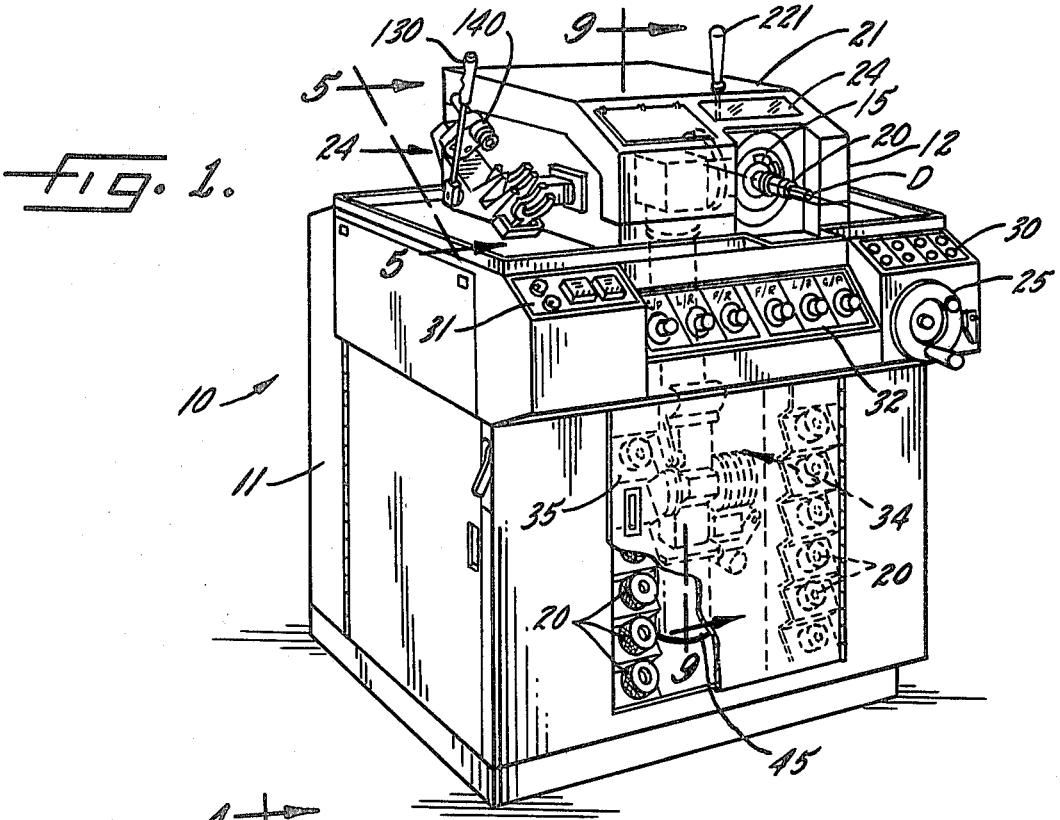
FIG. 1 is a front perspective of a drill point grinding machine embodying the present invention with a drill holder mounted in the machine workhead and a portion of a front access door broken away showing additional stored drill holders.
Figure 2:
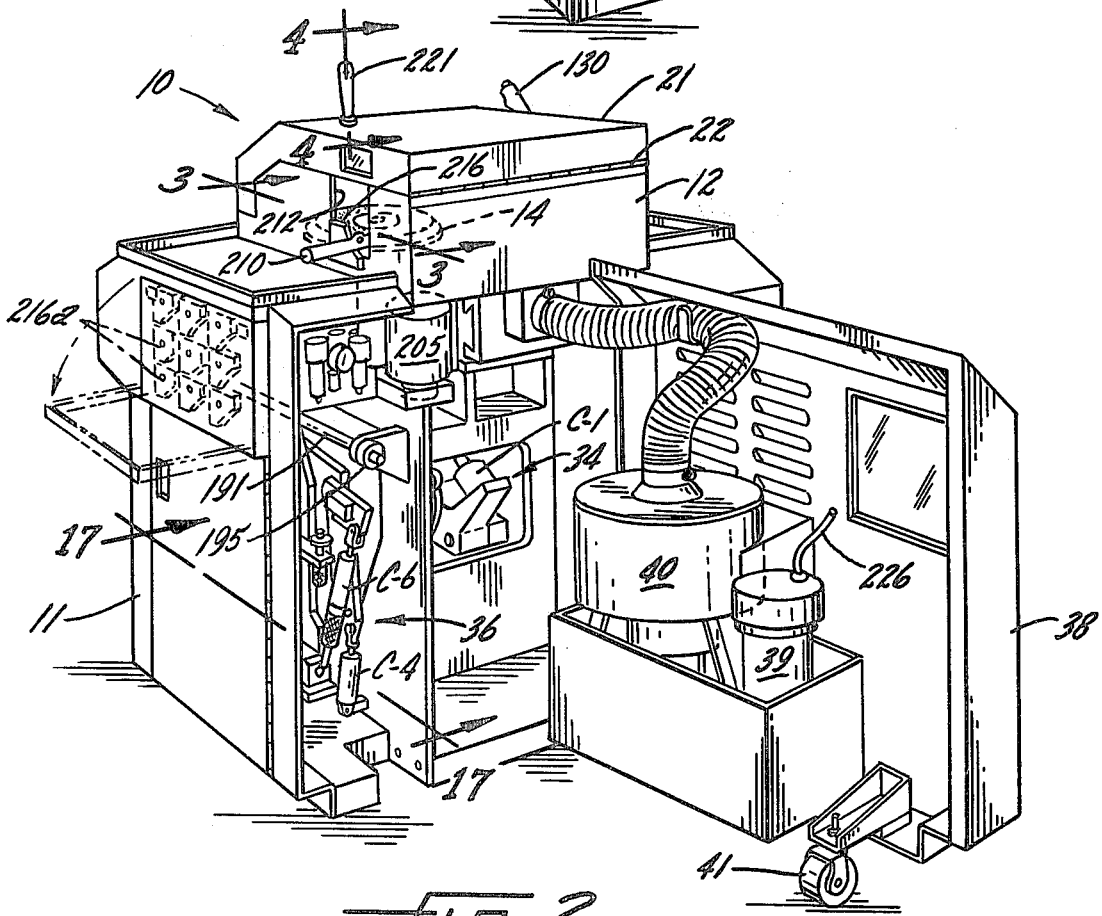
FIG. 2 is a rear perspective of the machine shown in FIG. 1 with a rear access door shown in an open position.
Figure 3:
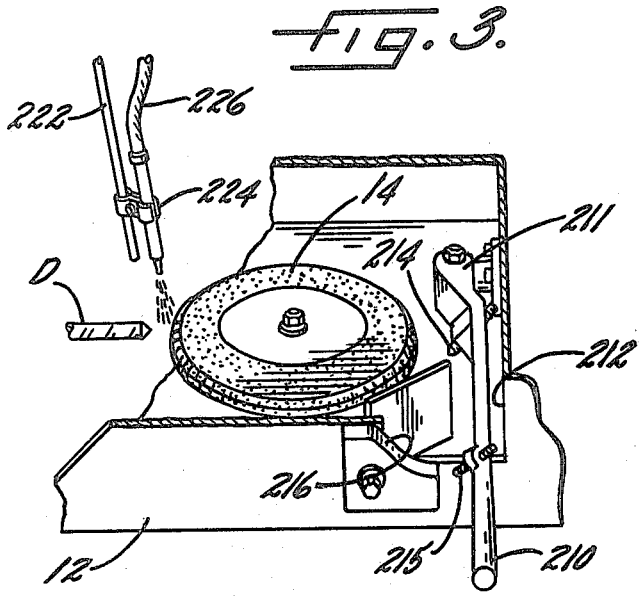
Figure 4:
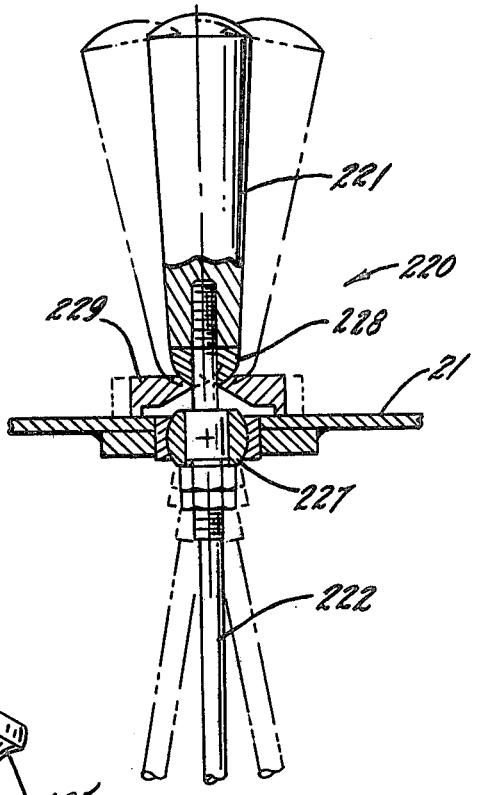
Figure 5:
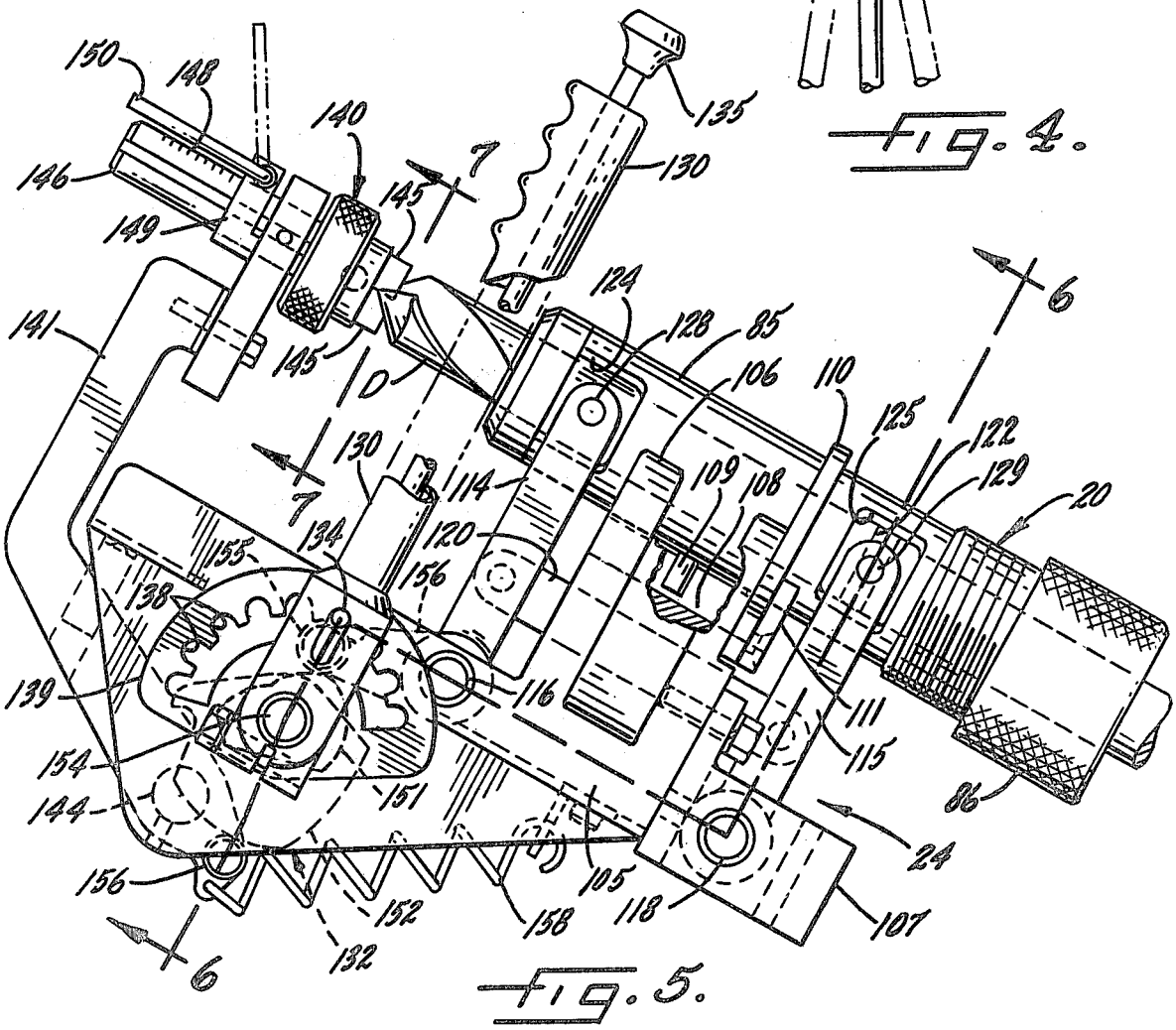
Figure 6:
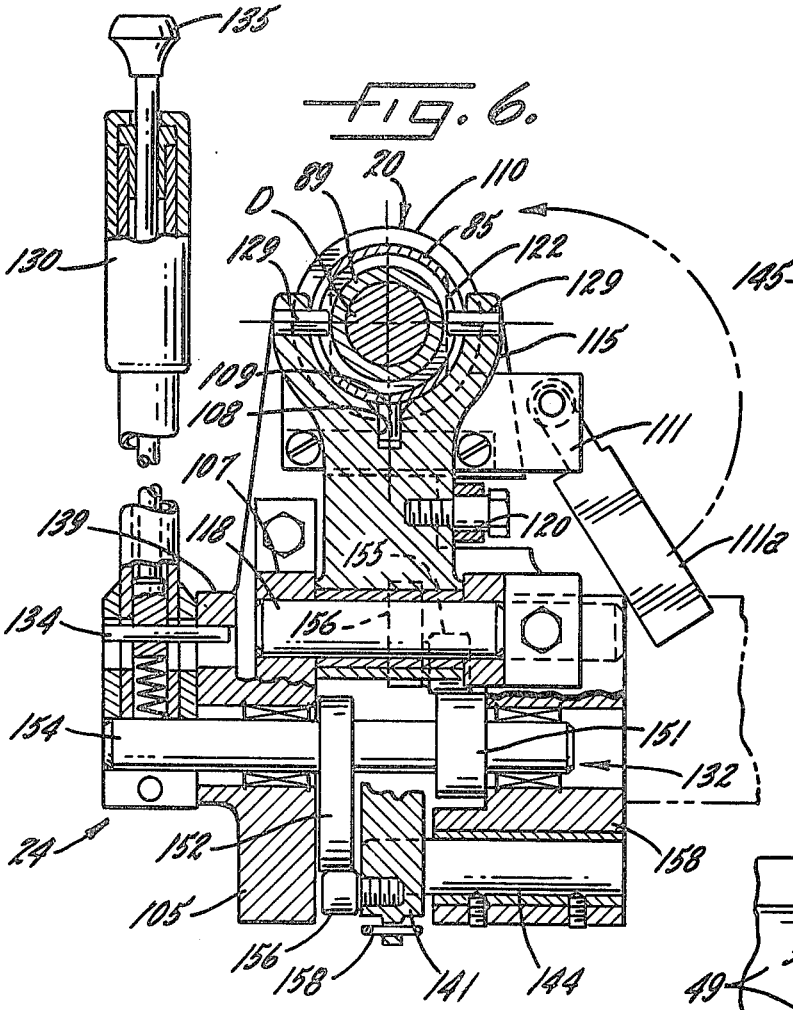
Figure 7:
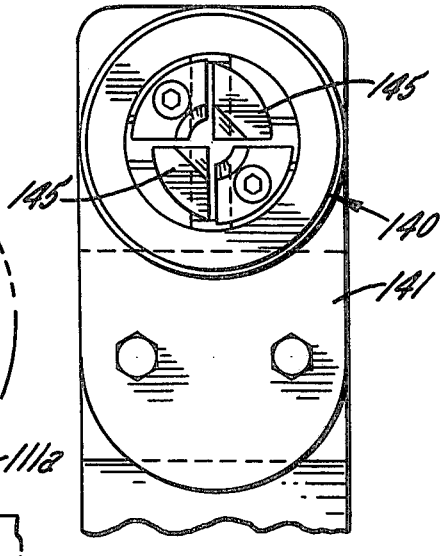
Figure 8:
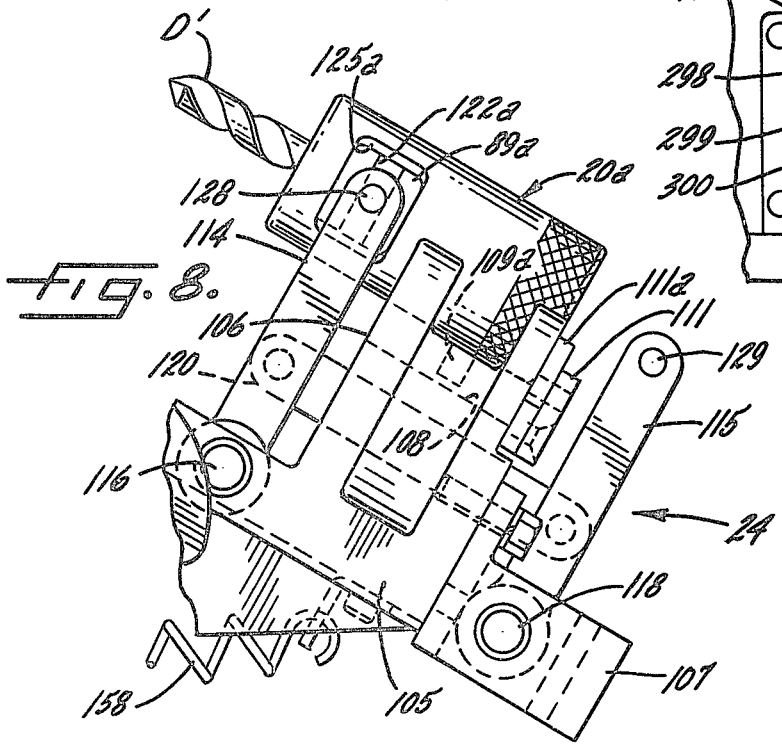
Figure 12:
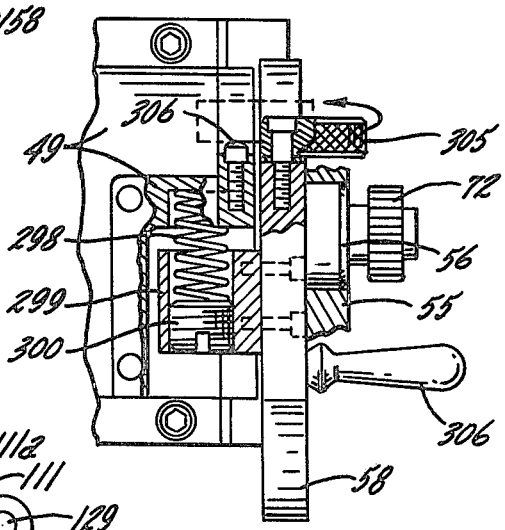
Figure 9:
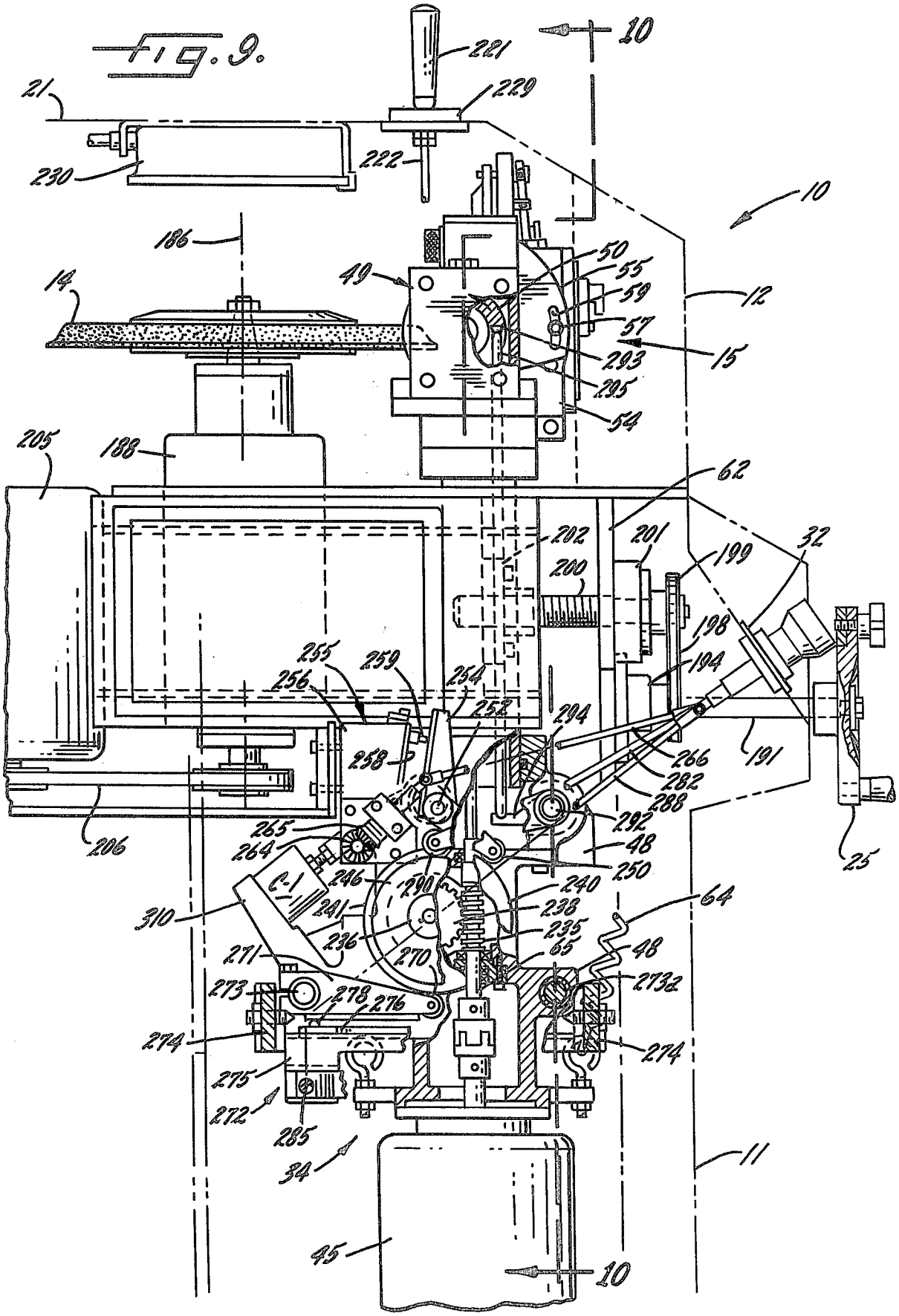
Figure 10:
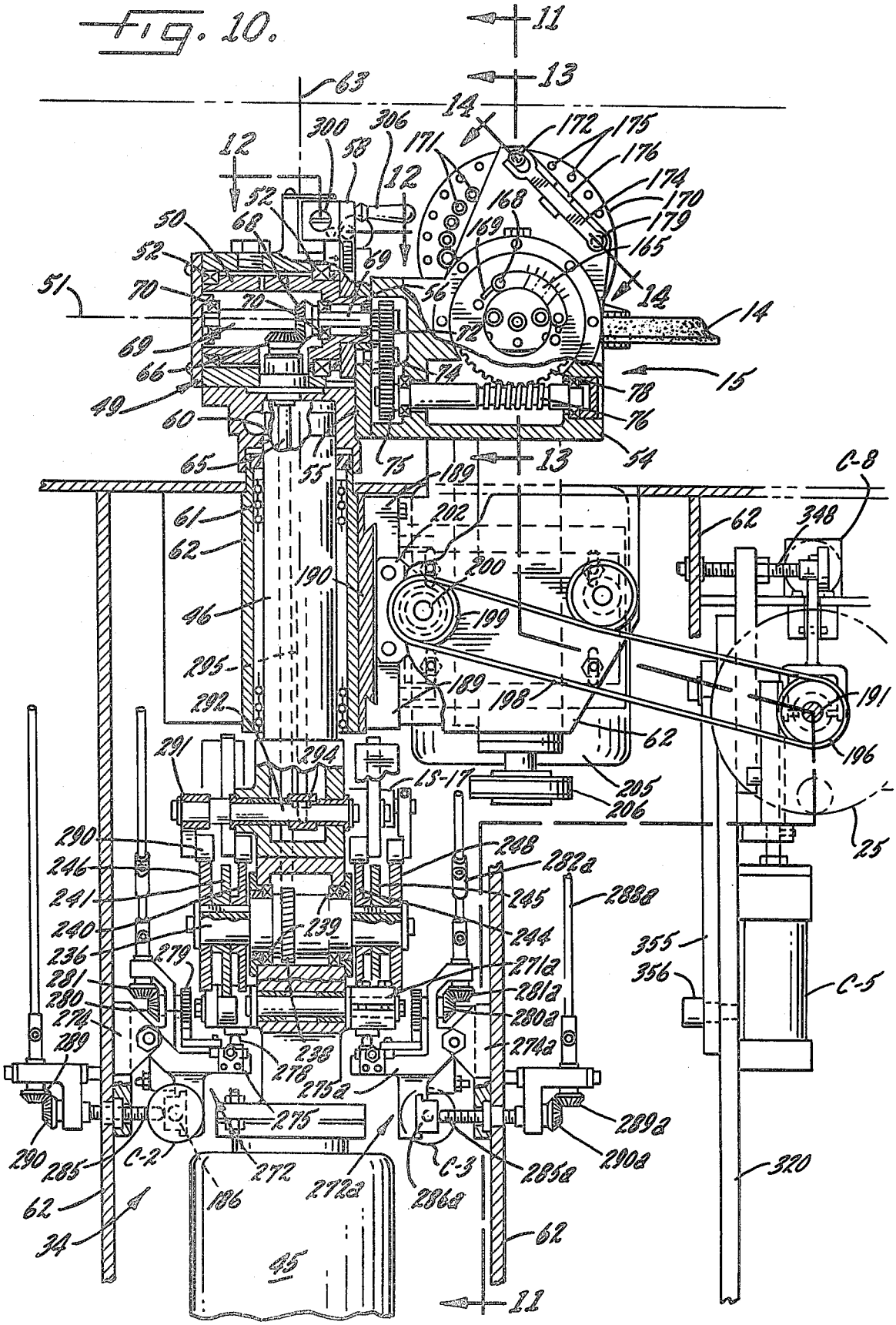
Figure 11:
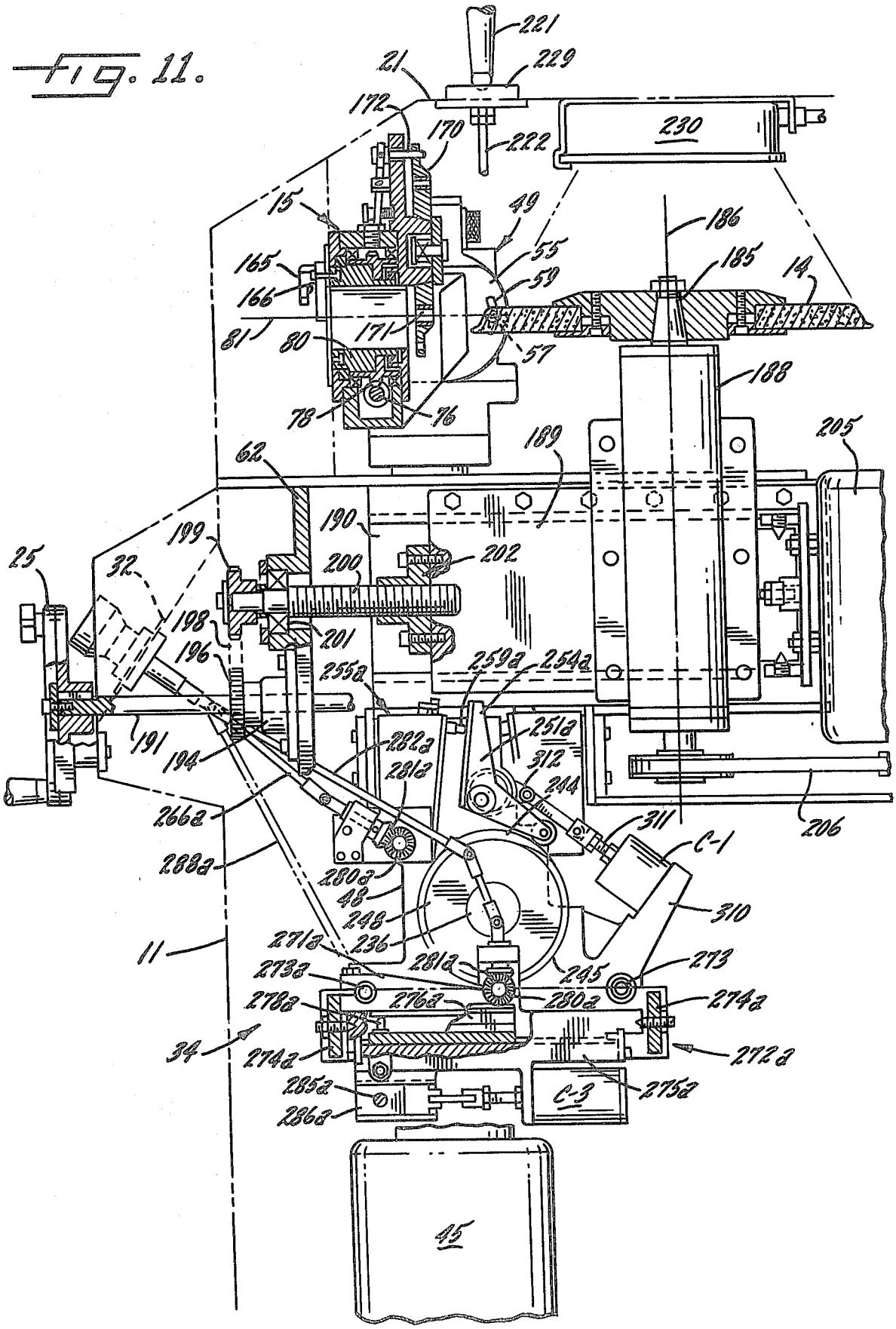
Figures 13, 14:
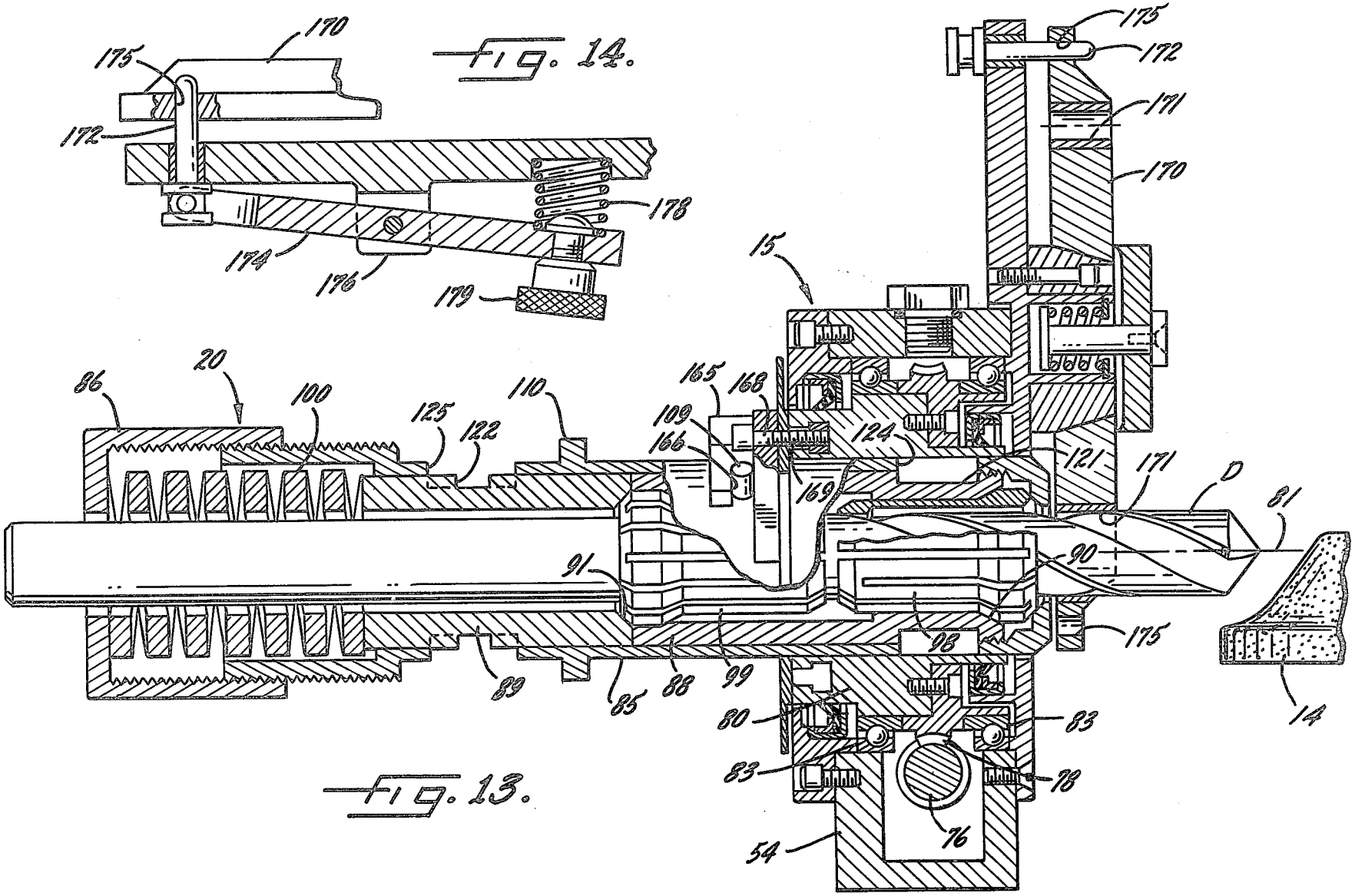
Figures 15, 16:
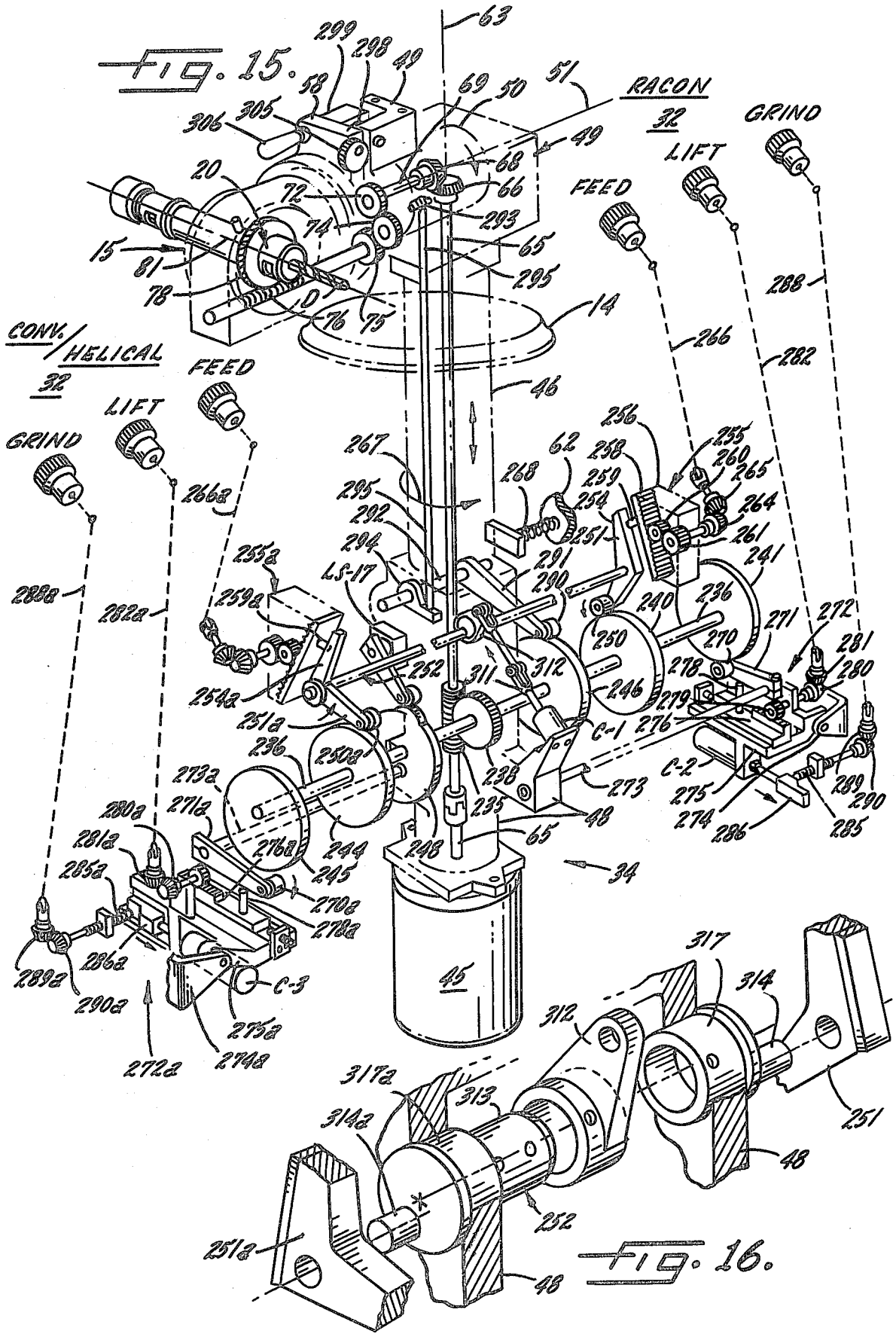
Figure 17:
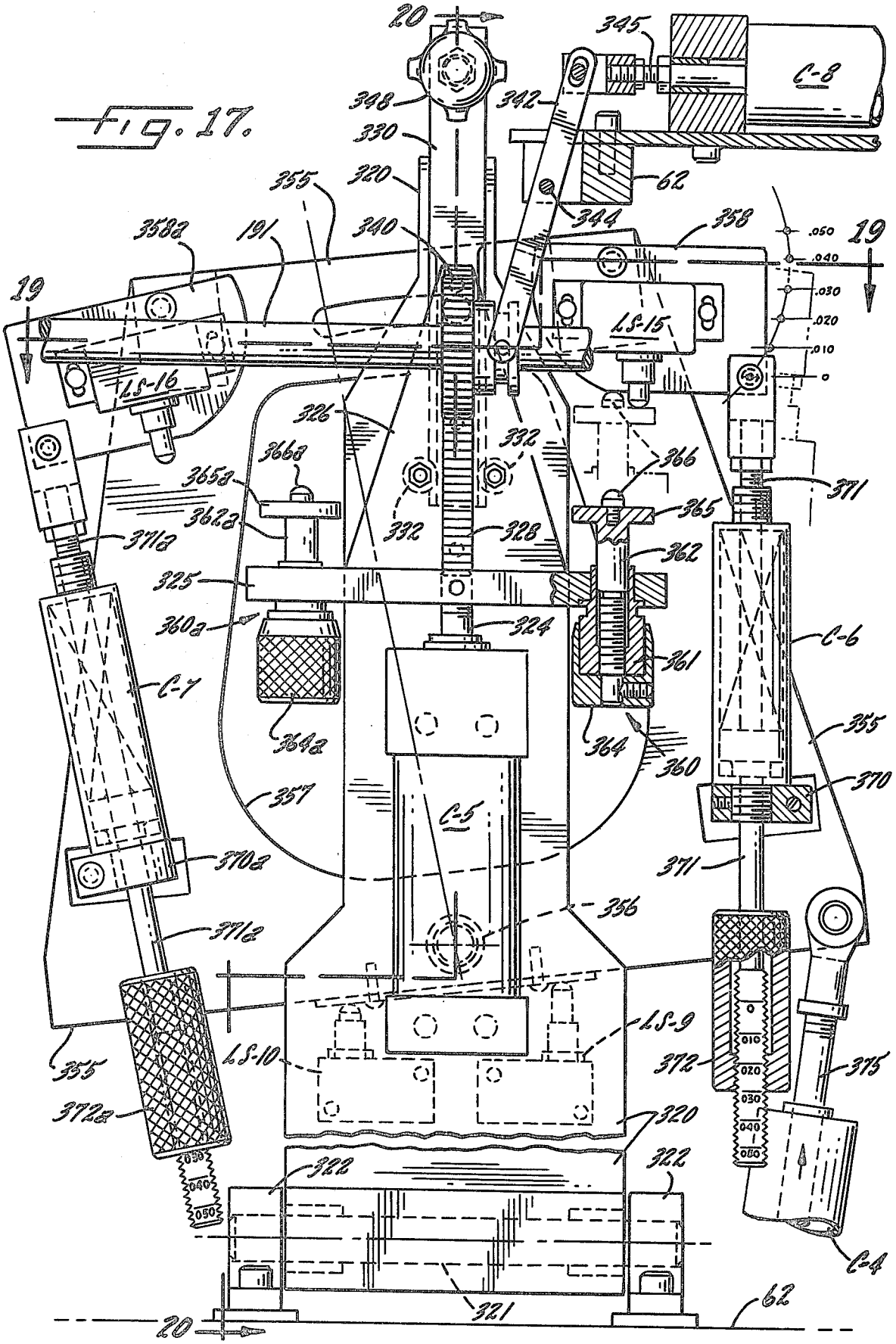
Figures 17A, 18:
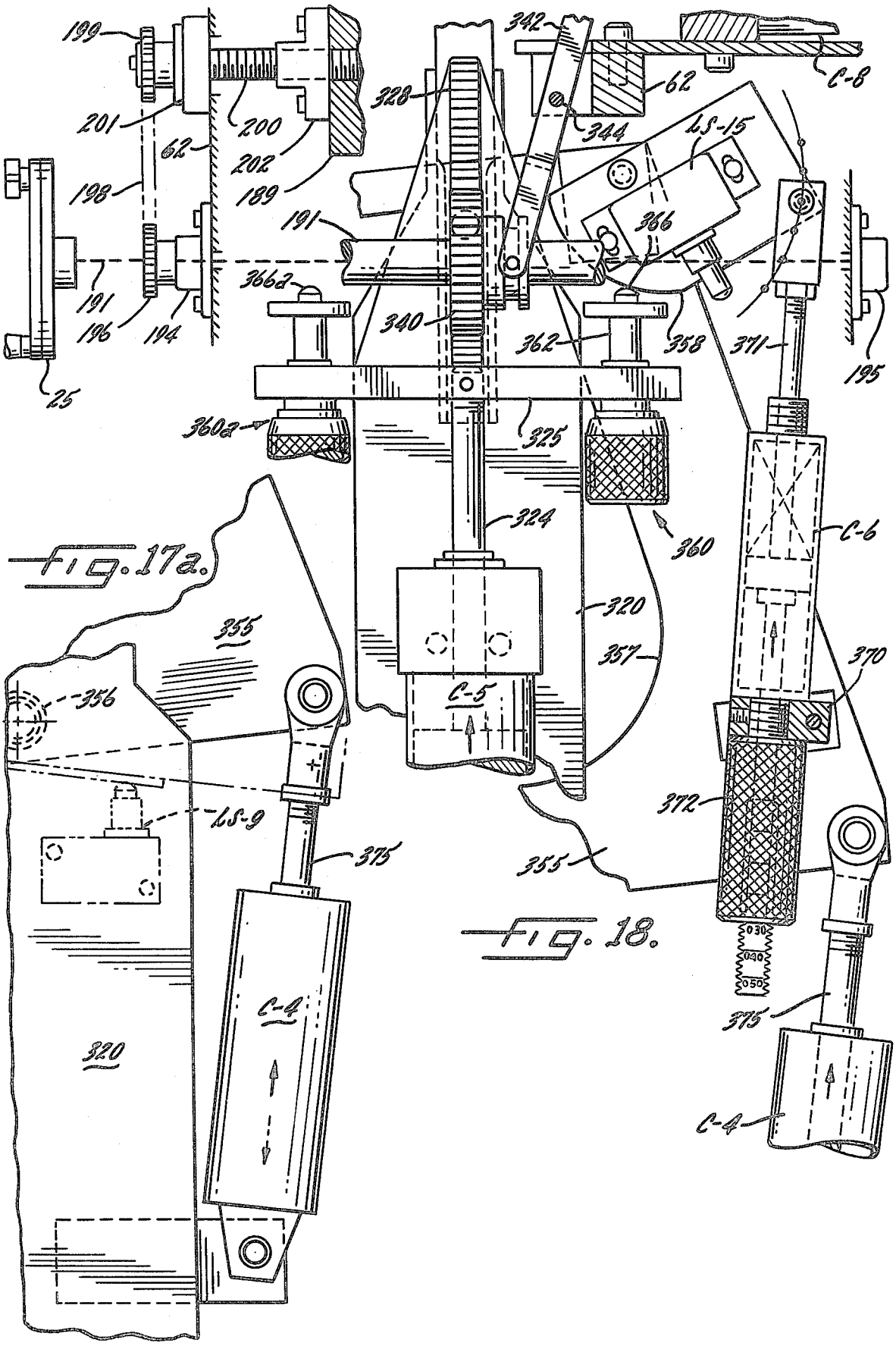
Figure 19:
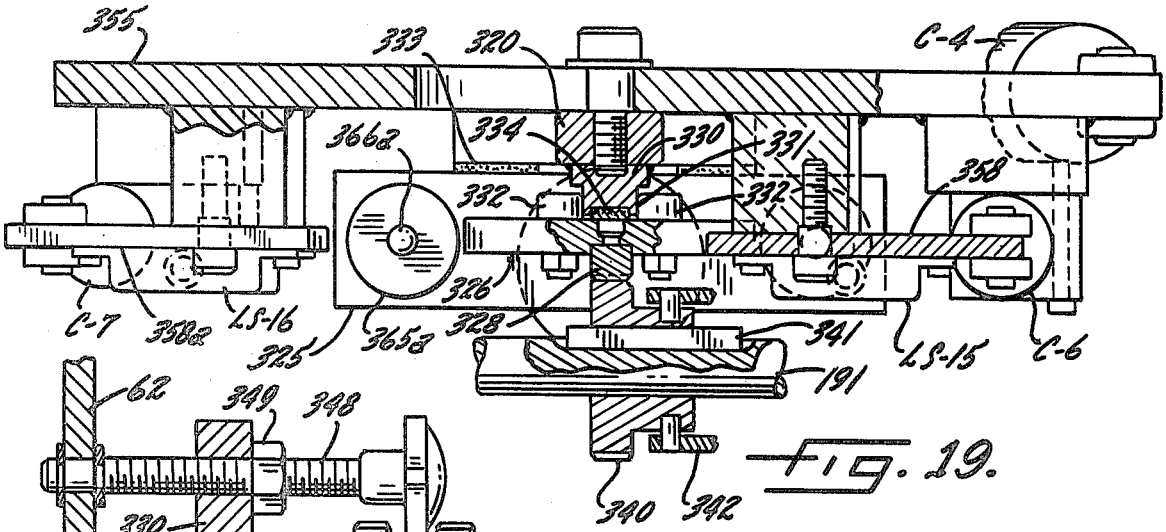
Figure 20:
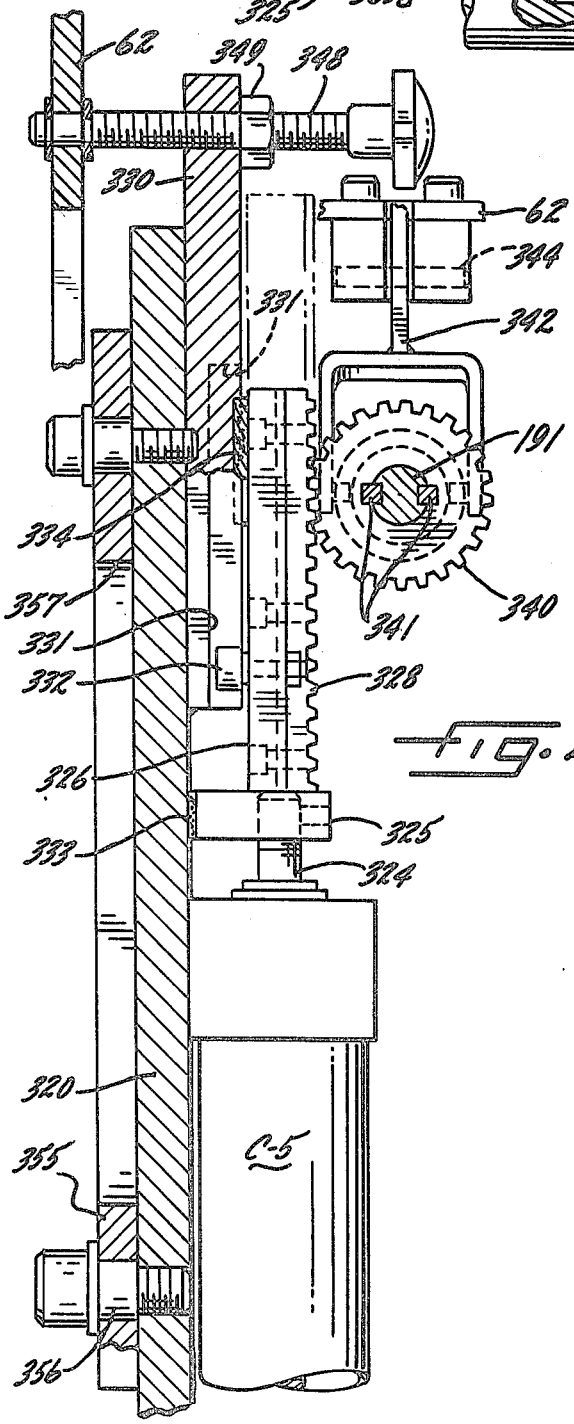
Figure 46:
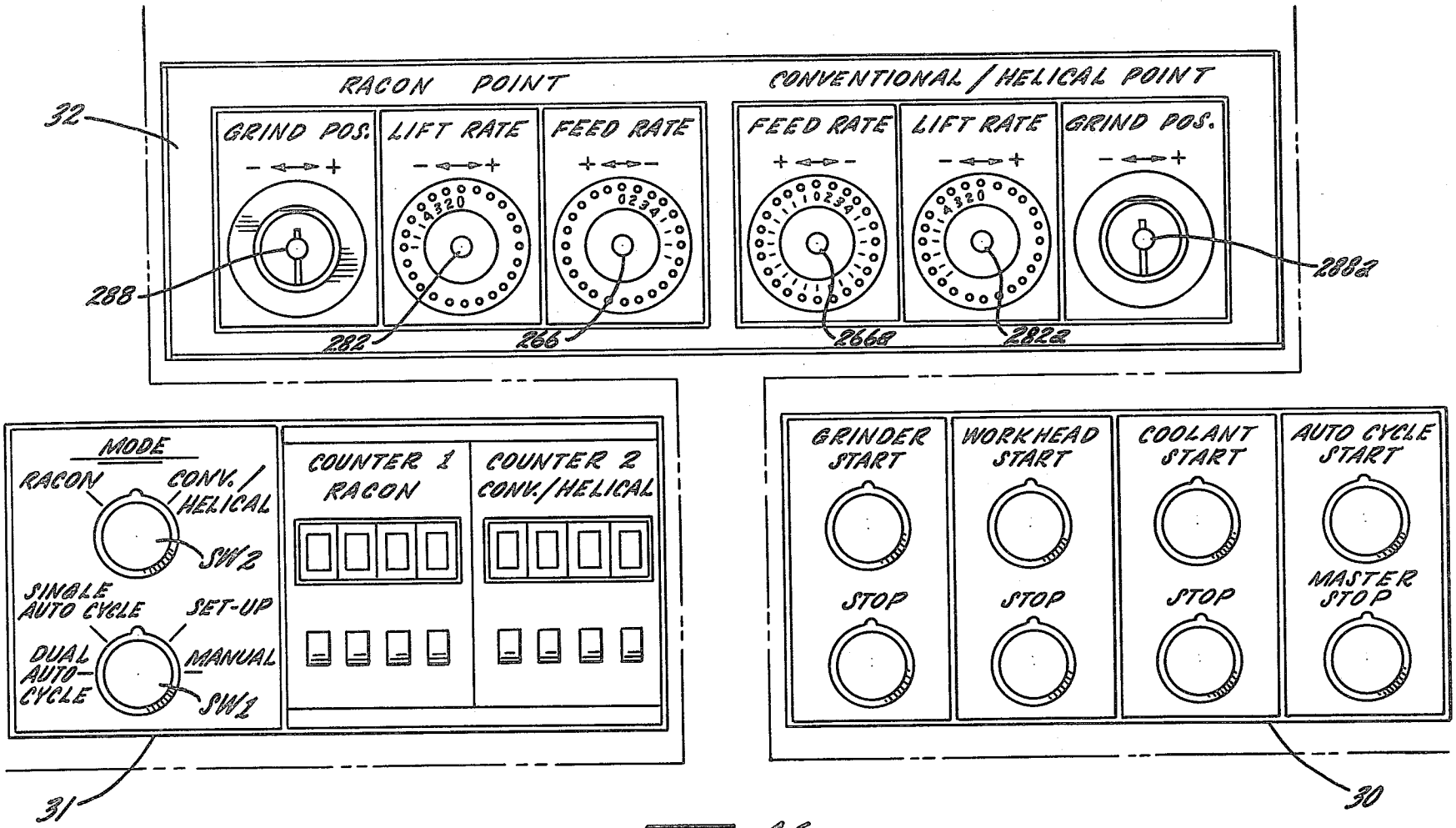

FIGS. 3 and 4 are enlarged fragmentary sections taken in the planes of lines 3—3 and 4—4, respectively, in FIG. 2;

FIG. 5 is an enlarged side elevational view of a drill loading jig included in the illustrated machine, taken in the plane of line 5—5 in FIG. 1, and having mounted therein a relatively large size drill holder and drill;

FIGS. 6 and 7 are vertical sections taken in the planes of lines 6—6 and 7—7, respectively, in FIG. 5;

FIG. 8 is a side elevational view of the drill loading jig shown in FIG. 5, having mounted therein a relatively small size drill holder and drill;

FIG. 9 is an enlarged fragmentary section taken in the plane of line 9—9 in FIG. 1;

FIG. 10 is a vertical section taken in the plane of line 10—10 in FIG. 9, but in this instance, without a drill holder in the workhead;

FIG. 11 is a vertical section taken in the plane of line 11—11 in FIG. 10;

FIG. 12 is an enlarged fragmentary section taken in the plane of line 12—12 in FIG. 10;

FIG. 13 is an enlarged fragmentary section taken in the plane of line 13—13 in FIG. 10 and showing a relatively large size drill holder in the workhead;

FIG. 14 is an enlarged fragmentary section taken in the plane of line 14—14 in FIG. 10;

FIG. 15 is a diagrammatic perspective view of certain operating parts of the support and drive mechanism for the drill holding workhead of the illustrative machine;

FIG. 16 is an enlarged perspective of selected parts, shown in disassembled condition, of a composite eccentric drive for the illustrated drive mechanism diagrammatically illustrated in FIG. 15;

FIG. 17 is an enlarged fragmentary section of apparatus for controlling motions of the grinding wheel for the specific drill point form to be ground, taken in the plane of line 17—17 in FIG. 2, and in this instance, showing the apparatus in operative condition for forming a radial-conventional or Racon drill point;

FIG. 17*a* is an enlarged view of a portion of the control apparatus shown in FIG. 17, after having been moved to a condition for grinding a helical drill point;

FIG. 18 is a partially diagrammatic view showing a portion of the apparatus shown in FIG. 17 during a Racon drill pointing operation;

FIGS. 19 and 20 are sections taken in the planes of lines 19—19 and 20—20, respectively, in FIG. 17;

FIGS. 21–27 illustrate the grinding action of the machine when generating a Racon drill point;

FIGS. 28–34 illustrate the grinding action of the machine when grinding a helical drill point;

FIGS. 35–41 illustrate the grinding action of the machine when grinding a conical drill point;

FIGS. 42–45 illustrate the grinding action of the machine when grinding a helical and radial-conventional or Bickford drill point;

FIG. 46 shows the control panels for the machine; and

Figure 47:
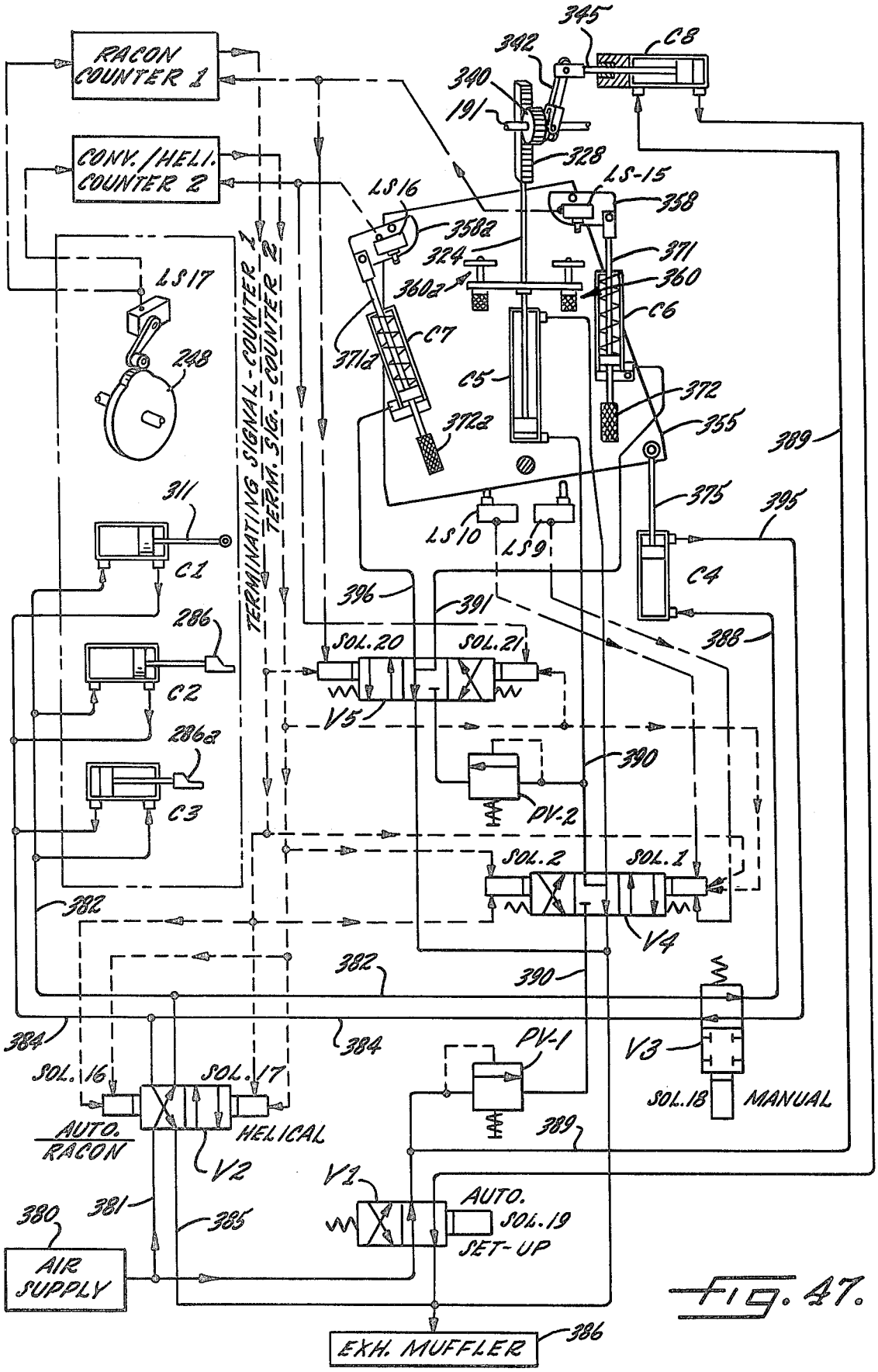

FIG. 47 is a schematic depicting the pneumatic control for the machine.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, and specifically to FIGS. 1 and 2, there is shown an illustrative drill point grinding machine 10 embodying the present invention. The machine 10 includes a main cabinet 11 and an upper closure 12 that covers a rotatably driven grinding wheel 14 and a workhead 15 which extend above the main cabinet. Removably mounted in the workhead 15 is a drill holder 20 which in turn supports a drill D on which a point is to be ground. A portion of the workhead 16, drill holder 20, and drill D in this instance are exposed through a front panel of the upper closure 12, as viewed in FIG. 1. The closure 12 includes a cover 21 that is pivotably mounted on a hinge 22 on the rear side thereof for allowing access to the grinding wheel 14 and workhead 15. The cover 21 also includes a window 24 to permit viewing of the work operation. Mounted on an outer side of the closure 12 immediately above the main cabinet 11 for easy accessibility is a loading jig 24 that is adapted to locate a drill D to be pointed in proper position in a drill holder 20 prior to positioning in the workhead 15.

The grinding wheel 14 in this case is mounted for selective translational positioning in a forward and rearward direction, as viewed in FIG. 1. The grinding wheel is adapted for automatic positioning as will become apparent, or alternatively, by manual positioning through a hand wheel 25 located at the front side of the machine. The drill holder 20 is mounted within the workhead 15 for (1) relative rotational movement about the axis of the workhead and (2) for movement with the workhead in (a) a forward and rearward feeding direction, (b) a lifting and lowering direction in a vertical plane, and (c) a pivotal or rocking direction about an axis parallel to the front of the machine. A control panel 30 is located at the right side of the machine, as viewed in FIG. 1, for starting and stopping the various motors of the machine, a control panel 31 is located at the opposite side of the machine for selecting the mode of operation and type of drill point to be ground, and a third control panel 32 is located in the center of the machine for controlling the rate of lift, feed, and starting position of the drill relative to the grinding wheel during a particular grinding mode.

A central compartment of the main cabinet 11 houses a support and mechanical drive apparatus, generally indicated at 34 in FIG. 1, for the workhead 15 and the grinding wheel 14. In this instance, a plurality of different sized drill holders 20 are also stored in the central compartment in two vertical rows on opposite sides of the drive apparatus 34 and a front opening door 35 is provided for access to that compartment. A compartment on the right side of the mechanical drive apparatus 34, as viewed in FIG. 1, houses a pneumatic control apparatus, generally indicated at 36 in FIG. 2, and a compartment on the opposite side of the mechanical drive apparatus 34 houses appropriate electrical control panels (not shown) for the machine. The main cabinet 11 has a rear door panel 38 within which is mounted a coolant motor 39 for importing coolant to the grinding wheel during a grinding operation and a mist collector 40 for collecting lubricant mist dispersed during the grinding operation and returning the lubricant to a coolant reservoir. The rear door panel 38 is provided with a wheel 41 to support pivotable opening and closing of the panel.

With reference to FIGS. 10 and 15, the support and drive apparatus 34 for the workhead 15 includes a motor 45 mounted at the lower end of a tubular support structure or shaft 46 through a coupling housing 48, a transmission housing 49 mounted at the upper end of the tubular shaft 46, and a rock arbor 50 pivotably mounted within the transmission housing 49 for supporting the workhead 15 for pivotal movement relative to the transmission housing 49 about an axis 51 of the rock arbor 50. For permitting such pivotal or rocking movement of the rock arbor 50 relative to the transmission housing 49, the rock arbor is supported therein by appropriate bearings 52. As best shown in FIG. 10, the workhead 15 has a housing 54 with a vertical mounting plate 55 that is apertured to rotatably fit on a protruding tubular end 56 of the rock arbor 50 extending out from the transmission housing 49. The workhead mounting plate 55 slidably seats on the tubular end 56 to a position adjacent an arbor plate 58 rigidly fixed on the tubular end 56 and is secured to the arbor plate 58 by appropriate screws 57 which extend through curved slots 59 in the workhead mounting plate 55 (one of which is shown in FIGS. 9 and 11) and threadably engage the arbor plate 58. The workhead 15, therefore, can be angularly adjusted relative to the rock arbor 50 about the axis 51 of the latter by loosening the fastening screws 57 and then re-locking the workhead 15 in a selected rotated position in the curved slots 59 such that the workhead will then be rotatable with the rock arbor 50.

The transmission housing 49 is fixedly mounted on the upper end of the tubular shaft 46, and for this purpose, the transmission housing defines a downwardly opening bore 60 for rigidly receiving the tubular shaft. The tubular shaft 46 in turn is disposed within a vertically oriented ball sleeve bearing 61 fixedly mounted on the frame 62 of the machine such that the tubular shaft 46, and thus the motor 45, transmission housing 49, and workhead 15 carried thereby, may be rotatably oscillated about an axis 63 of the tubular shaft 46 or vertically reciprocated along such axis. For flexibly supporting the tubular shaft within the ball sleeve bearing 61 to permit such movements, springs 64 are connected between the coupling housing 48 at the lower end of the tubular shaft 46 and the machine frame 62, as seen in FIG. 9.

For rotatably driving a drill holder 20 carried in the workhead 15, the drive motor 45 drives a vertical shaft 65 which extends through the housing 48 and tubular support shaft 46 and carries a bevel gear 66 at the upper end thereof which is located within the interior of the transmission housing 49 and rock arbor 50. As shown in FIGS. 10 and 15, the bevel gear 66 transmits the rotation of the vertical shaft 65, via bevel gear 68, to a horizontal stub shaft 69 which extends coaxially through the rock arbor 50 and is rotatably supported therein by bearings 70. The stub shaft 69 has one end which extends into the workhead housing 54 and has keyed thereto a pinion 72 which meshes with an idler 74 rotatably supported on the workhead housing end plate 55. The idler 74 in turn meshes with a pinion 75 keyed on the end of a worm shaft 76 also rotably supported in the workhead housing. Rotation of the worm shaft 76 drives a worm gear 78 secured to a workhead rotor 80 supported in the workhead housing by bearings 83 and within which is carried the tool holder 20, as shown in FIG. 13, for rotation about the axis 81 of the rotor 80.

In accordance with one aspect of the invention, the machine 10 is adapted to accommodate and grind a relatively large range of drill sizes. The drill holder 20, shown in FIG. 13, for example, carrier a relatively large size drill D, such as a 1" diameter drill. The illustrated drill holder 20 includes an elongated tubular sleeve 85 of a diameter sized for slidable positioning within the workhead rotor 80. The length of the sleeve 85 is such that when the drill holder is inserted in the workhead rotor 80 the forwardend of the drill holder protrudes a short distance beyond the workhead housing 54 and the rear end of the sleeve protrudes a substantial distance beyond the rear side of the workhead housing. A cap 86 threadably engages the rear end of the sleeve 85. Slidably disposed within the tool holder sleeve 85 in this case are front and rear axially collet sleeves 88, 89 which have respective tapered forward ends 90, 91 for engaging tapered shoulders of forward and rear collets 98, 99 respectively. The drill D to be ground is positioned coaxially through the drill holder 20, and a spring 100 interposed between the cap 86 and rear collet sleeve 89 acts to force the collet sleeves 88, 89 forwardly to the cam collets 98, 99 radially inward for secure gripping of the drill D.

For loading a drill D into a drill holder 20, the drill loading jig 24, shown in detail in FIGS. 5 and 6, is employed. The drill loading jig 24 includes a base 105 formed with an upstanding cradle 106 upon which a tool holder 20 may be positioned. To locate the drill holder 20 in predetermined angular position on the cradle 106, the cradle is formed with a longitudinal slot 108 for receiving a locating pin 109 extending outwardly of the drill holder sleeve 85. To axially position the drill holder 20 shown in FIG. 5 on the jig 24, the drill holder sleeve 85 also is formed with a radial flange 110 that is positioned against a transverse locating or abuttment member 111 transversely fixed across the rear of the cradle 106. Located on opposite sides of the cradle 106 are pivot yolks 114, 115, one of which is fixed to a shaft 116 rotatably mounted in the base 105 and the other of which is fixed to a shaft 118 rotatably mounted in an extension plate 107 of the base. The yolks 114, 115 stradle opposite ends of the drill holder sleeve 85 shown in FIG. 5, and a connecting link 120 is coupled between the upstanding yolks so that they may pivoted in unison upon pivotable movement of the forwardmost yolk 114.

The collet sleeves 88, 89 of the drill holder illustrated in FIGS. 5 and 13 have respective grooves 121, 122 which are exposed through respective openings 124, 125 in the outer drill holder sleeve 85, and the arms of the yolks 114, 115 each carry inwardly projecting lugs or pins 128, 129, respectively, which extend through the sleeve openings 124, 125 and into the respective collet grooves 121, 122. In this instance, the groove 122 in the rear collet sleeve 89 is a relatively narrow vertical slot approximately the width of the pin 129, while the groove 121 in the forward collet sleeve 88 is of a larger axial length, corresponding approximately with the length of the sleeve opening 124.

For selectively relieving the spring pressure on the tool holder collets 98, 99, the jig 24 has a handle 130 which when moved to the left, as viewed in FIG. 5, pivots the forward yolk 114, and thus the rear yolk 115 connected therethrough by the parallel linkage 120, to the right, as viewed in FIG. 5, through a cam mechanism 132, as will be explained later. Such pivotable movement of the yolk 115 causes the pins 129 to force the rear collet sleeve 89 rearwardly against the action of the collet spring 100, thereby relieving the radial contracting pressure of the rear collets 99, permitting rearward movement of the forward collet sleeve 88, and thereby relieving the radial contracting pressure of the forward collets 98. During such rearward movement of the collet sleeve 89 against the pressure of spring 100, the outer drill holder sleeve 85 remains stationary with the flange 110 abutting the locating or abuttment member 111 of the jig. In the present instance, the pressure of the collet spring 100 is relieved solely by forcing the rear collet sleeve 89 rearwardly under the action of the pins 129 of the rear pivot yolk, while the pins 128 of the forward yolk 114 are permitted to move in the larger axial openings 121 of the forward collet sleeve 88 without bearing engagement with that sleeve. The handle 130 in this case is provided with a spring loaded locking detent 134 located at the lower end of the handle which may be actuated by a pushbutton lever 135 at the top of the handle for enabling the handle to be retained at any given rotated position with the detent 134 is a selected notch 138 of a locking plate 139. With the radial contracting pressure of the collets 98, 99 relieved in such manner, a drill D may thereupon be removed from or inserted into the drill holder.

For locating each drill D to be pointed in a predetermined angular and axial position in the drill holder 20 after the drill is positioned into the opened collets 98, 99, a drill timing device 140 is provided at the end of an arm 141 that also is rotatable relative to the jig base 105 on a pivot shaft 144 in response to pivotal movement of the handle 130. As shown in FIGS. 5 and 7, the timing device 140 includes drill locators 145 which are adapted to be engaged by a drill tip and to stradle the web of the drill, thereby enabling the drill to be rotated to a predetermined angular position in the drill holder. The drill locators 145 in this instance are mounted on the end of a shaft 146 that is axially positionable in the arm 141 for the specific size drill that is to be loaded in the drill holder and for that purpose size graduations 148 are provided on the shaft 146. Once the shaft 146 is located in the proper axial position, it may be secured by a clamp 149 that engages the shaft upon lowering a hand lever 150 thereof to the position shown in FIG. 5.

To effect pivotal movement of the jig yolk 114 and the timing device arm 141 in response to pivotal movement of the handle 130, the cam mechanism 132 includes cams 151 and 152 fixed on a shaft 154 fixed to the handle 130. The cam 151 engages a roller 155 on an arm 156 extending from the pivot shaft 116 of the yolk 114. The cam 152 engages a roller 156 mounted on the arm 141 at a location offset from the pivot shaft 144 of such arm, the arm 141 being urged toward the cam 152 by a spring 158 connected between the end thereof and the jig base 105. The cams 151 and 152 are shaped to pivot the yolk 114 and arm 141 in opposite directions upon movement of the handle 130. Thus, when the handle 130 is swung in the clockwise direction as viewed in FIG. 5, the yolks 114 and 115 are swung to the right to release the collets 98, 99 of the drill holder and the arm 141 is released to swing to the left under the action of the spring 158. With the collets 98, 99 released, a drill D can thereupon be inserted into the drill holder and its tip engaged with the locators 145 of the timer 140 so that it is oriented in a predetermined angular position in the drill holder. The handle 130 can thereupon be swung in a counterclockwise direction, as viewed in FIG. 5. During the initial portion of this handle movement, the arm 141 is swung to the right by its cam 152, thereby pushing the drill D to a predetermined axial position in the drill holder. At this time, the cam 151 reaches a position wherein it releases the yolk 114, which causes the yolk 114 as well as the yoke 115 connected thereto, to swing to the left under the action of the collet spring 100, whereby the drill D is securely gripped in the drill holder. Finally, the cam 152 releases the arm 141 so that it is swung to the left, as viewed in FIG. 5, under the action of spring 158 away from the drill. The drill holder 20 with a drill D properly positioned therein may then be lifted from the jig for insertion into the workhead 15.

In keeping with the invention, the jig mounting device 24 is adapted to facilitate loading of a relatively large range of drill sizes. In addition to the large size drill holder 20 and drill D shown in FIGS. 5 and 13, a shorter length drill holder **20*a* carrying a smaller size drill D′ is shown in FIG. 8 mounted in the jig 24. The drill holder 20*a* in this instance also is a spring biased collet type, and as in the case of the drill holder 20, has a collet sleeve 89*a* formed with vertical slots 122*a* accessible through an opening 125*a* in the outer drill holder sleeve for receiving the pins 128 of the forward yolk 114. To accommodate the shorter length drill holder 20*a*, a moveable abuttment plate 111*a* is pivotally mounted on the abuttment 111 for selective positioning transversally across the cradle 106 to provide a rear seat for the drill holder 20*a*. As shown in FIG. 6, when the jig is used with longer length drill holders 20, the abuttment plate 111*a* is pivoted to a location outside the cradle 106. It will be understood that with the abuttment plate 111*a* in the position shown in FIG. 8, when the jig handle 130 is actuated, the yolk 114 will be moved in a rearward direction against a spring biasing force against the collet sleeve 89*a* so as to release the clamping action of the drill holder collet and permit insertion and removal of the drill, as well as its proper timing, in a manner similar to that previously described. During movement of the pivot yolk 114 in this case, the rear pivot yolk 115 moves idly. It will be seen that since the tool holder 20*a* is of the same diameter as the larger tool holder 20 it can be positioned in the workhead rotor 80 in the same manner. Thus, the tool loading jig 24**, as well as the grinding machine, are able to accommodate a relatively large range of drill sizes, including drills up to at least one inch in diameter.

In order to position a tool holder in predetermined axial and angular relation in the workhead rotor 80 after a drill has been positioned in the tool holder, there is bolted to the rear of the workhead rotor 80 a locating block 165 which is formed with a circumferential locating slot 166 for receiving the locating pin 109 of the drill holder sleeve 85, as shown in FIG. 13. It can be seen that the tool holder 20 can be removed from the workhead rotor 80 by first rotating the tool holder to disengage the pin 109 from the locating slot and then axially withdrawing the tool holder from the workhead rotor. The drill holder is inserted into the workhead by reversing these steps. In instances where it may be desirable to change the setting of the locating block 165, it preferably is secured by bolts 168 in a curved slot 169 in the workhead, as shown in FIG. 10, so as to permit loosening of the fastener bolts and circumferential adjustment.

To provide additional support for the end of the drill D protruding from the tool holder 20 during grinding and as it is rotated by the workhead, a drill bushing turret plate 170 is rotatably mounted on the forwardside of the workhead and carries a plurality of drill bushings 171 of different diameters. The bushings 171 are mounted at a common radial distance from the turning axis of the turret plate 170 such that each bushing may be rotated to the position, such as shown in FIG. 13, wherein the bushing axis coincides with the axis 81 of rotation of the workhead rotor 80 and tool holder 20. For retaining the turret plate 170 in a selected rotated position, a locating pin 172 is carried at the end of a pivot lever 174 for selective engagement in indexing holes 175 in the turret plate, as shown in FIGS. 10, 13, and 14. The pivot lever 174 in this instance is pivotally mounted intermediate its ends on an upstanding lug 176 with the locating pin 172 carried at one end thereof and the other end being biased in an upward or pin engaging position by a spring 178. It can be seen that by pushing a button 179 located at the biased end of the lever against the force of the spring 178, the lever 174 will be pivoted to a position removing the pin 172 from an indexing hole 175 in the turret plate, permitting the turret plate 170 to be rotated so that a different size bushing can be brought in alignment with the workhead rotor. With the release of the lever 174, the pin 172 will again be biased into locking engagement with the turret plate.

Referring now to the drive and mounting for the grinding wheel 14, as best shown in FIGS. 10 and 11, it can be seen that the grinding wheel is mounted on a shaft 185 which turns on a vertical axis 186. The grinding wheel shaft is rotatably supported in a housing 188 that is mounted on a carriage plate 189. As best shown in FIG. 10, the carriage plate 189 has a dove-tail guideway which is slidably positioned on a bevel-edged guide rail 190 bolted to the machine frame 62. The guide rail 190 extends in a forward and rearward direction of the machine, whereby the grinding wheel 14 is slidably supported for movement toward and away from the workhead 15.

To manually position the grinding wheel 14 along the length of the guide rail 190, the hand wheel 25 on the front of the machine is keyed to a shaft 191 which is rotatably supported in the machine frame by bearings 194, 195, shown in FIGS. 11 and 18. The shaft 191 carries a sprocket 196 that is operatively coupled by a chain 198 to a sprocket 199 carried on the forward end of a shaft 200, which in turn is rotatably supported in the machine frame 62 by a radial and thrust bearing 201. The righthand end of the shaft 200, as viewed in FIG. 11, threadably engages a nut plate 202 bolted to the end of the carriage plate 189. It is evident, therefore, that by manual rotation of the hand wheel 25, the grinding wheel 14 may be adjusted toward and away from the drill holder 20 supported in the workhead. As will become apparent later, the grinding wheel also may be automatically moved on the guide rail 190.

In order to permit operation of the grinding wheel 14 during its movement of the guide rail 190, the grinding wheel is driven by a motor 205 also mounted on the carriage plate 189 for simultaneous movement with the grinding wheel. The drive shaft of the motor 205 is coupled to the grinding wheel by a drive belt 206.

For periodic dressing of the grinding wheel 14 prior to or after use, a grinding wheel dresser 210 is mounted in the upper cabinet closure 12, as seen in FIG. 3. The dresser 210 is in the form of an arm, one end of which is mounted on a wall of the closure 12 by a double axis hinge 211 which permits both horizontal and vertical movement of the arm. The other end of the dresser arm extends through an opening 212 in the closure and serves as a handle for manipulation of the arm. On the side of the dresser arm facing the grinding wheel 14 is a dressing tool 214 of a known type. To control movement of the dresser arm, and thus the tool 214 carried thereby, the arm has a cam follower 215 which is adapted to engage and be moved along the contour of a cam 216 removably mounted on the outside of the closure wall.

The dresser 210 is used by first adjusting the grinding wheel 14 to its far right hand position, as viewed in FIG. 3, and then moving the dresser arm in accordance with the path defined by the cam 216 while the grinding wheel is driven by its motor 205. In order to accomodate grinding wheels of various grinding edge configurations, the cam 216 is removable and replaceable with any one of a plurality of cams **216*a* stored in a side compartment of the cabinet 11, as shown in FIG. 2**.

In keeping with a further aspect of the invention, a fluid directing device 220 is provided for selectively and adjustably directing coolant fluid onto the grinding wheel during a grinding operation. As shown in FIGS. 3 and 4, the device 220 includes a handle 221 vertically disposed above the closure 12 and a fluid line support rod 222 threadably engaging the lower end of the handle and extending downwardly into the interior of the closure. As shown in FIG. 3, attached to the lower end of the rod 222 by a clamp 224 is a fluid line 226 through which coolant can be directed. To permit selective pivotal positioning of the handle 221 and rod 222 relative to the closure, the handle and rod are supported by a spherical bearing 227 mounted in the top of the closure. For securing the handle and rod in a selected pivoted position, the handle 221 has a spherical shaped lower end 228 received in the spherical recess of a movable bearing plate 229 interposed between the upper surface of the closure cover 21 and the spherical handle end 227. It will be seen that by partially unthreading the handle 221 from the rod 222, the handle will be relieved from its clamping engagement with the bearing plate 229 permitting the handle and rod to be pivoted in the spherical bearing, as shown in phantom in FIG. 3, to a desired angular position for directing fluid from the line 226 onto the grinding edge of the wheel 14. During such pivotal movement, the bearing plate 229 will undergo slight sliding movement so as to remain under the end of handle. After the fluid line is properly oriented, the device 220 may be secured in such adjusted position by rotating the handle in a tightening direction onto the rod 222 until the spherical handle end 228 tightly engages the bearing plate 229. The fluid line 226 can thereby be selectively positioned for the specific location of the grinding wheel during a grinding operation. To provide sufficient light within the closure to view the grinding wheel from the window 24, a light 230 is mounted directly above the wheel, as shown in FIGS. 9 and 11.

From the foregoing, it can be seen that the grinding wheel 14 may be selectively positioned in a forward and rearward direction with respect to the workhead 15 and the drill holder 20 carried thereby. Moreover, the drill holder 20 is supported in the workhead 15 for (1) relative rotational movement about the workhead rotor axis 81, and (2) movement with the workhead in (a) an oscillating direction about the axis 63 of the tubular support shaft 46 for feeding and withdrawing the workhead relative to the grinding wheel, (b) a vertical reciprocating direction along the axis 63 for lifting and lowering the workhead, and (c) a pivotal direction with the rock arbor 50 about the rock arbor axis 51.

In accordance with a primary aspect of the present invention, provision is made for selectively effecting and controlling movements of the workhead and grinding wheel during a grinding operation such that any one of a multiplicity of drill point forms, including the conical, helical, Racon, or helicon, can be formed in a single machine setup. More particularly, first selectively operable control means driven from the workhead drive motor is provided for oscillating the workhead about and reciprocating the workhead along a vertical axis for grinding a first drill point form, and a second selectively operable means driven by the workhead drive motor is provided for oscillating and reciprocating the workhead along and about said axis to form a second drill point form. To this end, and with reference to FIGS. 9–11 and 15, the vertical drive shaft 65 driven by workhead drive motor 45 includes a worm section 235 disposed within the coupling housing 48 for driving a cam shaft 236 through a worm wheel 238 integrally formed on the shaft 236. The shaft 236 is rotatably supported by the housing 48 in bearings 239 and has opposite ends protruding outwardly of the housing. One end extension of the shaft 236 carries a first set of cams 240, 241 which can be selectively utilized to control vertical reciprocation (i.e. lifting and lowering movement) and transverse oscillation (i.e. feed movement) of the workhead along and about the tubular shaft axis 63 to grind a first or Racon form of drill point, and the opposite end extension of the shaft 236 carries a second set of cams 244, 245 which can be selectively utilized for controlling vertical reciprocation (lift) and transverse oscillation (feed) of the workhead to form a second or helical form of drill point. In addition, a rock cam 246 is mounted on the shaft 236 is selectively operable for controlling rocking movement of the workhead 15 about the rock arbor axis 51, which when combined with the movement of the second set of cams 244, 245, causes a conventional form of drill point to be ground. Finally, the shaft 236 carries a counter cam 248 for actuating a counter for counting the revolutions of the shaft 236, and thus the half cycles of operation of the workhead, as will become apparent. It will be understood that with reference to FIG. 15, the relative locations of the cams on the shaft 236 are only digrammatically illustrated.

Referring first to the operation of the radial-conventional or Racon drill point control cams 240, 241, it will be seen that the cam 241 is adapted to control the reciprocating lift and lowering movement of the workhead 15 and the cam 240 is adapted to control oscillating or feeding movement of the workhead. The feed cam 240 in this case is engaged by a cam follower roller 250 carried on the end of one arm of a bell crank 251 fixed to a shaft 252, as diagrammatically illustrated in FIG. 15, which in turn is rotatably supported by the coupling housing 48. The bell crank 251 has a second arm 254 extending in a generally upward direction. Located immediately adjacent the bell crank arm 254 is a movable fulcrum device 255 comprising a housing 256 which is mounted on the machine frame and carries a slidable rack 258 having an upstanding fulcrum pin 259 upon which the crank arm 254 may bear. To selectively position the rack 258, and thus the fulcrum pin 259, along the length of the crank arm 254, the housing 256 supports an idler pinion 260 which is interposed between the rack 258 and a pinion 261 keyed to a shaft which extends from the housing and carries a bevel gear 264. The bevel gear 264 meshes with a bevel gear 265 carried on a flexible shaft 266 which is coupled to the FEED RATE knob for the Racon mode of operation on the control panel 32 on the front of the machine.

During rotation of the cam 240 as the high point of the cam approaches the cam follower roller 250 the bell crank 251 will pivot in a clockwise direction, as diagrammatically viewed in FIG. 15, thereby urging the arm 254 against the fulcrum pin 259. The thrust of the bell crank arm 251 against the fulcrum creates a torque on the housing 48 and support shaft 46 through the shaft 252 which rotates the housing and support shaft in the direction indicated by the arrow 267 in FIG. 15. A spring 268 coupled between the machine frame 62 and the tubular support shaft 46 urges the latter in the opposite direction about the shaft axis 63. Accordingly, rotation of the cam 240 by the motor 45 is effective to oscillate the tubular support, and workhead carried thereby, about the axis 63. It will be understood that adjustment of the fulcrum pin 259 along the bell crank arm 254, though adjustment of rack 258, will vary the oscillatory stroke of the workhead.

Referring now to the cam 241 for controlling lift of the workhead during the radial-conventional or Racon drill pointing mode of operation, it can be seen that the cam 241 is engaged by a cam follower roller 270 carried on one end of an arm 271 that is fixedly mounted on a shaft 273 fixed to the coupling housing 48. Mounted directly under the cam follower arm, as diagrammatically shown in FIG. 15 and further shown in FIGS. 9 and 10, is an adjustable and movable fulcrum device 272. The fulcrum device 272 includes a bracket 274 which is mounted to the machine frame and pivotably supports an arm 275. A slide 276 carrying an upstanding fulcrum pin 278 upon which the follower arm 271 bears is slidably positionable on the bracket arm 275 in a direction generally parallel to the follower arm 271. For adjusting the location of the slide 276 and thus the fulcrum pin 278 mounted thereon relative to the follower arm 271, the slide has an upper generally horizontally disposed rack. A pinion 279 meshes with the rack and may be driven via a bevel gear 280 mounted on a common shaft therewith, which in turn can be driven from a bevel gear 281 at the end of a flexible or universal shaft 282 connected to a LIFT RATE knob for the Racon point mode located on the control panel 32 on the front of the machine. Thus, the fulcrum pin 278 may be adjusted by turning the LIFT RATE knob. It can be seen, therefore, that during rotation of the cam 241 by the drive motor 45, as the high point of the cam approaches the cam roller 270, the thrust of the roller arm 271 against the fulcrum pin 278 reacts on the coupling housing 48 and support shaft 46, lifting the workhead in the direction of the axis 63. As the high point of the cam 241 recedes from the roller 270 during continued rotation of the cam, the workhead descends under the force of gravity against the counterbalancing force of the spring 64. Thus, rotation of the cam 241 is effective to reciprocate the workhead along the axis 63, and adjustment of the fulcrum pin 278 along the cam follower arm 271 will vary the reciprocatory stroke of the workhead.

For adjusting the initial vertical or lift position of the workhead 15 prior to start up of the grinding operation, an adjusting screw 285 is provided which in this instance seats against a wedge block 286 carried at the outer end of a rod of a pneumatic cylinder C-2 fixed to the underside of the arm 275. The screw 285 is coupled to a third control knob designated GRIND POS. for the Racon operating mode on the control panel 32 on the front of the machine through a shaft 288 and bevel gears 289, 290, and is thereby adapted to adjust the extended position of the screw 285. Adjustment of the screw, therefore, is effective to adjust the pivotal positioning of the arm 275 on the bracket 274, and thus the elevation of the fulcrum pin 278. For example, if the screw 285 is adjusted toward the wedge block 286 the arm 275 is rotated upwardly, as viewed in FIG. 15, raising the fulcrum pin 278, and thereby raising the support shaft 46 and workhead 15. It will be understood, however, that the reciprocatory stroke of the workhead 15 is determined by the position of the fulcrum pin 278 along the arm 271 and is not effected by the adjusting screw 285.

The apparatus associated with the second set of cams 244, 245 for effecting feed and lift of the workhead during a helical drill pointing mode of operation is substantially identical to the apparatus associated with the Racon feed and lift cams, and similar items have been given similar reference numerals with the distinguishing suffix "a". The adjustable fulcrum devices 255*a*, 272*a* associated with the respective helical feed and lift cams 244, 245 in this case are located on an opposite side of the support shaft 46 than the fulcrum devices for the Racon feed and lift cams and are reversely oriented. It will be seen that by rotation of the FEED RATE knob located on the control panel 32 for the conventional/-helical point mode of operation, the fulcrum 259*a* similarly can be adjusted with respect to the bell crank arm 254*a* for the helical feed cam 244, and thus, establish the desired reciprocating feed stroke during the helical mode of operation. Adjustment of the GRIND POS. knob for the conventional/helical point mode will set the initial vertical position of the workhead, and rotation of the LIFT RATE knob adjusts the position of the fulcrum pin 278*a*, and thus, the reciprocatory lifting stroke during a helical grinding mode.

To effect rocking movement of the workhead 15 relative to the transmission housing 49 and support shaft 46 about the rock arbor axis 51, the rock cam 246 is engaged by a follower 290 disposed at one end of a follow arm 291, the other end of which is fixed to a shaft 292 rotatably carried by the coupling housing 48. The shaft 292 extends into the housing 48 and has fixedly coupled thereto an arm 294 upon which seats the lower end of a push rod 295. The push rod 295 extends upwardly through the tubular shaft 46 into the transmission housing 49 and rock arbor 50. The underside of the rock arbor 50 at one end thereof is cut away to define a seating surface 293 for the upper end of the push rod 295, as shown in FIG. 9. For biasing the rock arbor 50 into engagement with the upper push rod end, a spring 298 is interposed between an upstanding extension of the transmission housing 49 and a casing 299 secured to the rock arbor plate 58, as shown in FIG. 12. The casing 299 in this instance includes a setscrew 300 at one end thereof for adjusting the spring pressure. It will be seen, therefore, that in response to rotation of the rock cam 246 through operation of the motor 45, the push rod 295 will be reciprocated, in turn causing a rocking movement of the rock arbor 50 and workhead 15 about the rock arbor axis 51 against the biasing force of the spring 298.

In order to lock out the rocking action of the workhead when unnecessary in a grinding operation, a pivotal locking member 305 is provided, as shown in FIGS. 12 and 15. By means of a handle 306 secured to the rock arbor plate 58, the rock arbor 50 may be rotated against the force of the biasing spring 298 to a point that the locking member 305 may be rotated to a locking position, as shown in phantom in FIG. 12, bearing against a pin 306 secured to the transmission housing 49. In such position, the locking member 306 will retain the rock arbor 50 in a retracted position such that a clearance is maintained between the upper end of the push rod 295 and the rock arbor seat 293. In such locked position, the workhead 15 remains in a fixed angular position with respect to the transmission housing 49. The push rod 295 remains free for axial movement by the rock cam 246 during such time, but has no effect on the rock arbor or workhead.

In carrying out the invention, means are provided for selectively rendering operative either said first set of workhead control cams for grinding the Racon drill point form or the second set of workhead control cams for generating a helical type drill point form. More particularly, means are provided for rendering operative one of said sets of workhead control cams while simultaneously rendering inoperative the other set. To this end, in the illustrated embodiment, for selectively activating and de-activating the Racon and helical feed cams 240, 244, a pneumatic cylinder C-1 is secured to an extension 310 of the coupling housing 48 and has a cylinder rod 311 pivotably coupled to the outer end of an arm 312 fixed to the shaft 252 upon which the bell cranks 251, 251*a* for the respective feed cams 240, 244 are mounted. It will be seen that by actuation of the cylinder C-1 the rod 311 thereof may be extended and retracted to rotate the arm 312 and shaft 252 between determined limits. The bell cranks 251, 251*a* in this instance are eccentrically mounted on the shaft 252 such that when the follower roller 250 on the bell crank 251 for the Racon feed cam is in engagement with such cam 240, the follower roller 250*a* for the bell crank 251*a* for the helical feed cam 244 out of engagement. As illustrated in FIG. 16, the shaft 252 in this instance comprises a central stub shaft 313 and end caps 317, 317*a* fixed on opposite ends of the stub shaft, and the bell cranks 251, 251*a* are mounted on respective eccentric pins 314, 314*a* of end caps 317, 317*a*. Thus, when the cylinder C-1 is caused to retract its plunger rod 311 so as to move the arm 312 in a downward direction as viewed in FIG. 15, the resulting rotation of the shaft 252 rotates the bell crank 251 to a position such that its follower is out of engagement with the Racon feed cam 240, while simultaneously moving the bell crank 251*a* for the helical feed cam 244 into operative engagement with that cam. Through operation of the cylinder C-1, therefore, the feed control mechanism for the helical mode of operation may be rendered operative while simultaneously rendering inoperative the feed control mechanism for the Racon mode, and vice versa.

The lift control mechanisms for the Racon lift cam 241 and the helical lift cam 245 may be rendered operative and inoperative through operation of the respective pneumatic cylinders C-2 and C-3, again as can be seen in FIG. 15. For example, when the cylinder C-2 is caused to move its plunger rod to a retracted position the wedge blades 286 will be moved from a position in which the thick portion thereof is adjacent the end of the screw 285 to a position in which the narrow end is adjacent such screw end, allowing the arm 275 to be lowered by the weight of gravity, and thereby causing the fulcrum pin 278, arm 271 and follower 270 to be moved out of engagement with the lift cam 241. Likewise, when the cylinder C-3 is caused to move its plunger rod outwardly from the position shown in FIG. 15, this will move the bevel block **286*a* from a position in which the narrow end portion is in bearing engagement with the end of screw 285*a* to a position in which the screw end bears against the raised or thicker portion of the bevel block, which cams the arm 275*a* upwardly as viewed in FIG. 15, thereby raising the fulcrum pin 278*a*, arm 271*a* and follower 270*a* from an inoperative position, as shown in FIG. 15, to an operative position in which the follower 270*a* is engagement with the helical lift cam 245**.

It will be seen that through selective utilization of either the Racon control cam 240, 241 or the helical control cams 244, 245 the machine 10 will be capable of grinding Racon and helical drill point forms, respectively. Through utilization of the helical control cams 244, 245 together with rocking movement of the workhead imparted by the rock cam 246, the conventional drill point form may be ground. In each case, the motor 45 simultaneously will transversely oscillate the workhead 15 relative to the vertical tubular support shaft axis 63 to effect feeding and withdrawal of the workhead and drill, vertically reciprocate the workhead along the same axis for effecting lifting and lowering movement of the workhead, and rotatably drive the workhead rotor 80 and the drill D carried therein, as previously explained. The oscillatory and reciprocatory motions of the workhead, and thus the feed and lift movements of the drill D, are timed and synchronized, by the proper shaping and relative angular orientation of the lift and feed cams such that the drill D will be moved through a cyclic compound grinding motion. During each cycle of motion of the drill D, the drill point can be moved to a position of initial contact with the grinding wheel, then across the grinding wheel to a terminal grind position, and then be removed from the grinding wheel and returned to its position of initial contact.

Figure 21:
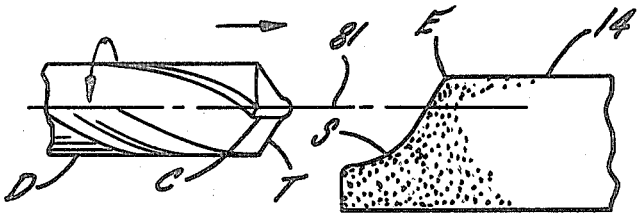
Figure 22:
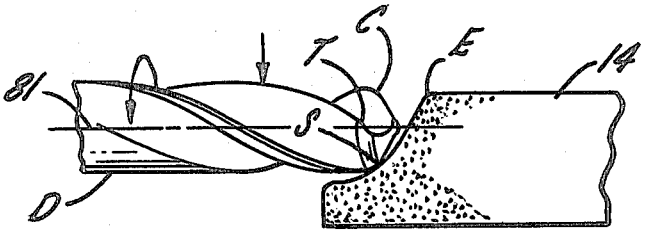
Figure 24:
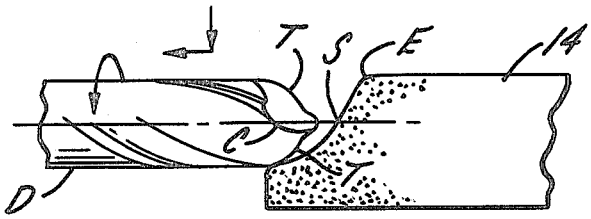

The mode of grinding the Racon or radial-conventional drill point form, for example, is illustrated in FIGS. 21–27. In this case, the workhead lock member 305 is swung to its engaged or locking position wherein the workhead 15 is locked against rocking movement, and the rock cam 246 and push rod 295 move idly. The angle of the drill axis relative to the grinding surface S of the grinding wheel 14 can then be determined by the particular angular setting of the workhead 15 relative to the rock arbor plate 58, and in the illustrated embodiment, the workhead is set so that the drill axis is approximately horizontal. FIG. 21 shows the drill when the workhead occupies the upper limit of its reciprocatory or lift stroke along the axis 63 and the outer limit of its oscillatory stroke when the workhead is at its greatest distance from the grinding wheel 14. From the foregoing, it is apparent that such initial vertical starting position of the drill D may be established by adjustment of the GRIND POS. knob which sets the vertical position of the workhead 15 and the grinding wheel 14 may be adjusted by the handwheel 25 to a predetermined starting position spaced from the drill. During the first part of the cycle, the drill is moved axially forward into contact with the lower curved portion of the grinding surface S, as shown in FIG. 21, at which time lowering movement of the drill commences as seen in FIG. 22. As the drill point is lowered, it is simultaneously moved in an axially rearward direction, whereby the drill tip moves from its position of initial contact (FIG. 22), through an intermediate position (FIG. 23), to a terminal grind position (FIG. 24). During a final portion of the cycle of the drill motion, the workhead is moved away from the grinding wheel and upwardly so as to return the drill to its initial position of FIG. 21, whereupon the cycle of drill motion is repeated for the next land of the drill.

Figure 25:
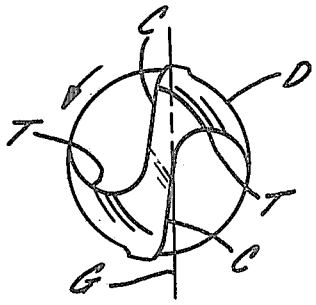
Figure 23:
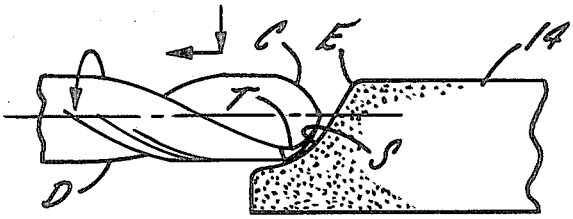
Figure 26:
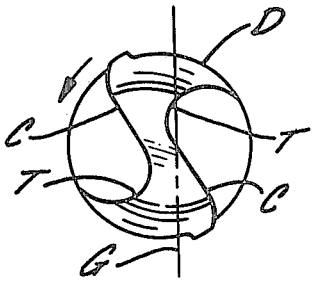
Figure 27:
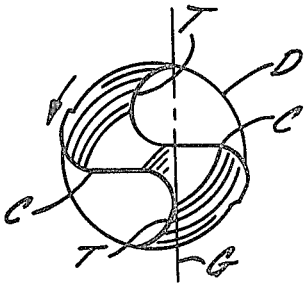

During the foregoing motion, as previously indicated, the drill is also rotating on its axis, as illustrated in FIGS. 25–27. As is known in the art, such rotation of the drill is timed and synchronized with the compound axial and vertical drill motion described above. In FIGS. 25–27, the reference C denotes the leading or cutting edge of each drill land, the reference T denotes the trailing edge of each land, and the dotted line G represents the effective line contact between the grinding surface S and the engaged drill land.

The rotational movement of the drill D is timed so that in its position of initial contact (FIG. 22) the leading edge C of the engaged drill land is located approximately in a plane containing the axis 186 of the grinding wheel 14 and the line of contact G with the grinding surface S approximately coincides with the leading edge of the land, as shown. The leading edge of the land is thereby ground is substantially in conformity to the curvature of the curved lower portion of the grinding surface S. As the drill tip moves downwardly and rearwardly on the grinding surface S, through the positions of FIGS. 25–27, the drill continues to rotate, with the result that the line G of contact with the grinding wheel moves progressively to the trailing edge T of the land, as is evident from FIG. 27. The land surface is thereby progressively ground toward the trailing edge, and at the same time, by virtue of the curved lower half of the grinding surface S, the outer periphery of the drill point near the shank is formed with a generally curved or rounded contour.

As will be understood by one skilled in the art, the axial, vertical, and rotational motions of the drill are so timed that during return of the drill from the terminal grind position in FIGS. 24 and 27, to the initial cycle position of FIG. 21, the leading edge C of the following land of the drill is rotated to the position of FIG. 21 for grinding in the same manner. Thus, the surfaces of the drill lands are successively ground and reground until the drill is properly pointed. The drill point configuration which is thereby generated is commonly referred to as the radial-conventional or the Racon point.

The helical drill point, as previously indicated, may be generated by controlling the workhead movement through utilization of the helical feed and lift cams 244, 245 with effect of the rock cam 246 again locked out. The cyclic grinding motion the drill D undergoes for grinding the helical drill point is illustrated in FIGS.

Figure 28:
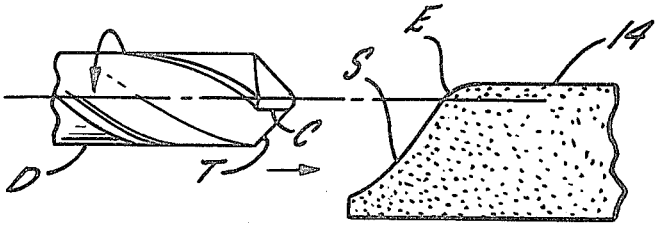
Figure 29:
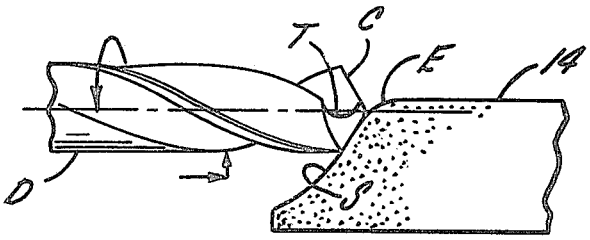
Figure 31:
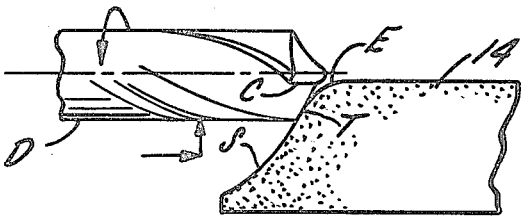

28–34. FIG. 28 shows the initial position of the drill axially spaced from the grinding surface, which in this instance, is the lower limit of the reciprocatory lift stroke of the workhead along the axis 63. When the drill D is axially advanced into contact with the grinding surface, as shown in FIG. 29, the drill point engages the upper portion of the grinding surface. During this part of the cycle, the drill is simultaneously advanced further toward the grinding wheel and moved upwardly toward the grinding edge E, whereby the drill tip moves from its initial contact (FIG. 29), through an intermediate position (FIG. 30), to a terminal grind position (FIG. 31). To complete the cycle of drill motion, the workhead is then moved away from the grinding wheel and downward to the initial position of FIG. 28.

Figure 32:
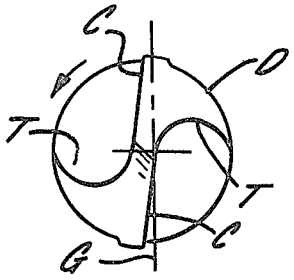
Figure 30:
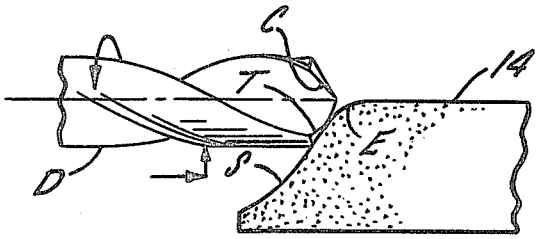
Figure 33:
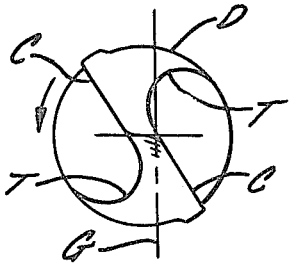
Figure 34:
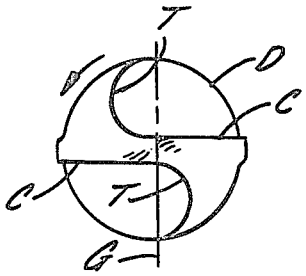

During the foregoing helical drill point forming motions, the drill again is rotating on its axis, as illustrated in FIGS. 32–34. Upon initial contact of the drill D with the grinding wheel (FIGS. 29, 31), the leading edge C of the engaged drill land again is located approximately in the plane of the grinding wheel axis, whereby the line of contact G of the grinding surface S with the land approximately coincides with the leading edge of the land, as shown. Since the upper portion of the grinding surface S which is utilized for grinding the helical drill point is substantially flat, the leading edge of the land can be ground at the angle of such grinding surface when the drill is horizontally advanced, as illustrated. As the drill moves upwardly along the grinding surface, through the positions of FIGS. 33 and 34, with the drill continuing to rotate, the line of contact G with the grinding surface progresses toward the trailing edge T of the land. As is known in the art, by properly advancing the rotary drill tip forwardly while engaged with the upper grinding edge E, the forwardmost tip surface generated will assume a helical or S configuration and the tip can be undercut slightly in the immediately adjacent area to form a crown effect. Again, the successive land can be ground in the same way, and such cycles repeated until the drill tip is properly pointed. The drill point configuration which is thereby generated is commonly referred to as a helical point and has a slightly curved or S shaped centering point as shown.

Grinding of the conventional or conical drill point is illustrated in FIGS. 35–41 and involves utilization of workhead movements generated by the helical feed and lift cams 244, 245, as well as rocking motion of the workhead about the rock arbor axis 51 generated by the rock cam 246. To activate such rocking motion, the lock member 305 rotated to the unlocked position shown in FIGS. 12, which releases the workhead 15 for rocking or oscillatory motion about the rock arbor axis 51 under the action of the rock cam 246 and push rod 295. In addition, for grinding the conventional drill point in the illustrated embodiment, a grinding wheel 14*a* having a generally straight bevel grinding surface S and an upper edge E of a smaller radius is employed.

Figure 35:
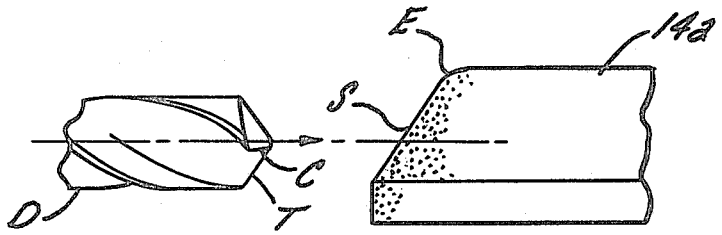

FIG. 35 illustrates the drill D at an initial position in the conventional grinding cycle. In this position, the drill axis is substantially horizontal and the workhead is at about the lower limit of its reciprocatory vertical stroke and spaced away from grinding surface S. During the first part of the grinding cycle, the drill is axially advanced toward the grinding wheel and moved upwardly, while the drill tip is rotated downwardly about the workhead rocking axis 51 in such a way that the drill tip is moved to the position of initial contact, shown in FIGS. 36 and 39. In this position, the leading or cutting edge C of one drill land approximately parallels the rotation axis of the grinding wheel, whereby the line of contact G of the grinding surface with a drill tip approximately coincides with the leading edge C.

Figure 36:
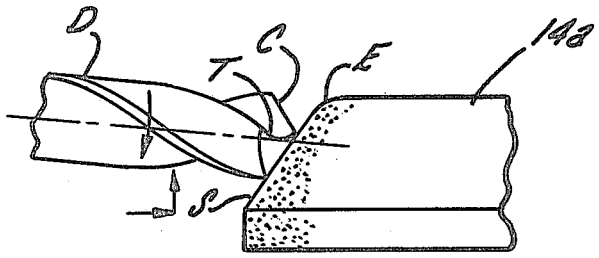
Figure 39:
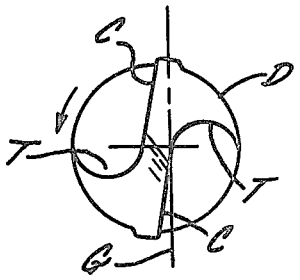
Figure 37:
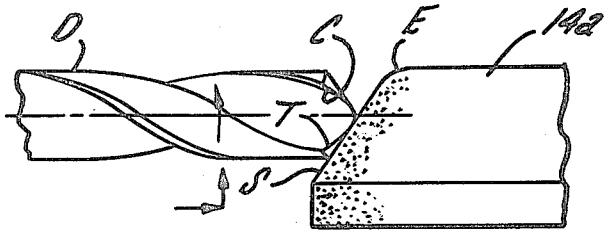
Figure 40:
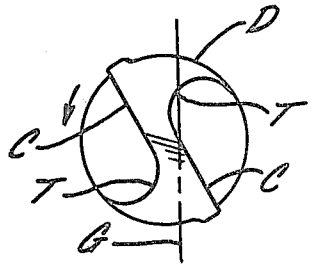
Figure 38:
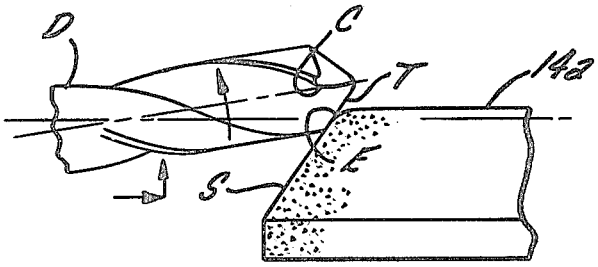
Figure 41:
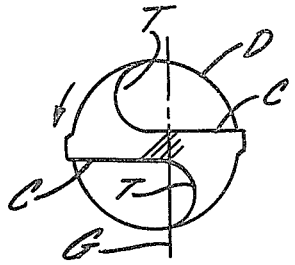

During the next portion of the cycle, as the workhead continues to axially advance the drill toward the grinding surface and to elevate the drill, and the drill tip commences to rotate upwardly about the rocking axis 51, whereby the drill point moves from its position of initial contact FIGS. 36 and 39, through the intermediate position of FIGS. 37 and 40, to the terminal grinding position of FIGS. 38 and 41. The drill, of course, continues to rotate during and in synchronism with such motions, whereby the drill tip travels upwardly along the grinding surface S toward and finally across the grinding edge E. The drill is then returned to the inital position shown in FIG. 35. The resulting tip surface, as is known in the art, is approximately conical in shape and is commonly referred to as the conical or conventional drill point.

In carrying out an important aspect of the invention, means are provided for selectively and automatically controlling the foregoing drill pointing modes of operation and for combining the first and second modes (i.e., the Racon and helical modes) to grind still another drill point from (i.e., the helicon drill point). To this end, means are further provided for automatically and precisely controlling movement of the grinding wheel during such automatic operation of the machine. With reference to FIGS. 17–20, there is shown a grinding wheel feed control apparatus adapted for automatically controlling the placement and feed of the grinding wheel 14 during either a Racon or helical mode of operation. The grinding wheel feed apparatus includes an upstanding support 320 which in this case is pivotably mounted on a shaft 321 between upstanding brackets 322 secured to the machine frame. The support 320 has mounted thereon a pneumatic cylinder C-5 having a cylinder rod 324 upwardly directed and carrying a transverse flange 325 and an upwardly extending plate 326 upon which a vertically disposed rack 328 is mounted. To guide movement of the cylinder rod 324, transverse flange 325, plate 326, and the rack 328 mounted thereon upon actuation of the cylinder C-5, and thus upon extension and retraction of the cylinder rod 324, the upstanding support 320 has mounted thereon a guide rail 330 which defines guideway 331 on each side thereof for guiding rolling movement of a pair of spaced rollers 332 mounted on the underside of the plate 326. To further facilitate such relative movement, a wear plate 333 is mounted on the underside of the transverse flange 325 and a similar wear plate 334 is secured to the underside of the plate 326.

The rack 328 is located adjacent the grinding wheel feed shaft 191, as shown in FIGS. 17–20, and the latter carries a pinion 340 adapted for selective engagement with the rack 328. To permit selective positioning of the pinion 340 along the shaft 191 from an operative position engaging the rack, as shown in FIG. 17, to an inoperative position out of engagement with the rack, the pinion 340 is slidably mounted on the shaft along an elongated drive key 341 (shown in FIG. 19) and is coupled to one end of a pivot link 342 pivotably mounted to the frame 62 at a pivot point 344 intermediate its ends. The opposite end of the pivot link 342 is coupled to a plunger rod 345 of a pneumatic cylinder C-8, also fixed to the machine frame. Upon extension of the plunger rod 345 to the left, as viewed in FIG. 17, the lower end of the pivot links 342 will be moved to the right moving the pinion 340 out of engagement with the rack. Movement of the cylinder rod 345 in the opposite direction will re-engage the pinion with the rack. In order to permit transverse adjustment of the location of the rack 328 relative to the pinion 340 for insuring proper driving engagement therebetween, an adjusting screw 348 in this instance threadably extends through an upper end of the plate 330 secured to the upstanding support 320 and has an unthreaded end rotatably held in the machine frame 62. Through rotation of the screw 348, the support 320 can thereby be pivoted to a position for insuring proper meshing of the rack 328 and pinion 340. A nut 349 secures the screw 348 in its adjusted position.

It can be seen, therefore, that when the pinion 340 is in the rack engaging position, vertical extension of the rod 324, through actuation of the pneumatic cylinder C-5, will drive the pinion 340 and shaft 191, which in turn will drive the grinding wheel feed rod 200 (FIG. 10) through the chain 198 and move the grinding wheel 14 along its guide rail 190 toward the workhead 15. Retraction of the cylinder rod 324, and thus the rack 328, will similarly move the grinding wheel in a direction away from the workhead. As will become apparent, by properly establishing the position of the grinding wheel during setup of the machine, the cylinder C-5 may be utilized for automatically moving the grinding wheel into initial contact with a drill D held in the machine workhead during a grinding operation.

For permitting further limited feeding movement of the grinding wheel during a grinding operation, as well as enabling the grinding wheel to be fed at predetermined different rates during the helical and Racon operating modes, a selectively adjustable plate 355 is mounted on the upstanding support 320 for pivotal movement about a pivot pin 356. The illustrated pivot plate 355 is formed with a central opening 357 to reduce its mass and to enable access to associated apparatus. The plate 355 pivotably carries a grinding wheel feed control cam 358 for the Racon mode of operation on one upper side thereof and a feed control **358*a* for the helical mode of operation on the opposite upper side thereof. The feed control cams 358, 358*a*** in turn each carry respective limit switches LS-15 and LS-16.

For cooperation with the respective feed control cams **358, 358*a* the transverse plunger rod plate 325 of the cylinder C-5 has mounted thereon respective micro dials 360, 360*a*. The micro dials each include a barrel 361, 361*a* fixed within the cylinder rod flange 325 and an upstanding vertically disposed shaft 362, 362*a* threadably engaging the barrel. Fixed to a lower protruding end of the shaft 362, 362*a* is a thimble 364, 364*a* which can be rotated relative to the barrel to advance or retract the shaft 362, 362*a* therein. The uppermost end of the shaft 362, 362*a* is formed with a stop flange 365, 365*a* and mounted centrally thereon is a follower button 366, 366*a***.

For pivoting the grinding wheel feed cams **358, 358*a* relative to the mounting plate 355, respective cylinders C-6 and C-7 are provided. With reference to a cylinder C-6, it can be seen that it is pivotably mounted on the plate 355 by a bracket 370 and has a plunger rod 371 extending out opposite ends of the cylinder. The upper end of the plunger rod 371 is pivotably connected to the cam 358 while the lower end is threaded for receiving an adjustable stop feed member 372. It will be seen that upon actuation of the pneumatic cylinder C-6 outward extension of the upper end of the rod 371, and thus pivotal movement of the cam 358, can be controlled by the axial position of the stop member 372 on the lower threaded end of the rod 371. To facilitate precise adjustment of the stop member 372** the rod end in this case bears graduations. The cylinder C-7 is similar to cylinder C-6 and the components thereof have been given similar reference numerals with the distinguishing suffix "a" added.

The grinding wheel feed control apparatus is illustrated in FIGS. 17 and 18 with the pivot plate 355 in position for the Racon operating mode. In such condition, the pivot plate 355 is pivoted to the left, as viewed in FIG. 17, such that the Racon feed cam 358 is disposed directly above the Racon micro dial 360 while the helical feed cam **358*a* is located to the left of the helical micro dial 360*a*, as viewed in FIG. 17. It will be appreciated that prior to start up of the grinding operation, the grinding wheel 14 may be advanced manually by the hand wheel 25 to a position in which it makes initial contact with the drill D carried in the workhead. With the pinion 340 engaging the rack 328, such manual rotation of the shaft 191 will advance the rack 328 upwardly, moving the micro dial 360 to a position in close proximity to the Racon cam 358 when the pivot plate 355 is in the Racon position shown in FIG. 17. The micro dial 360 may thereupon be adjusted such that its follower button 366 engages the cam surface as shown in phantom in FIG. 17. Manual removal of the grinding wheel 14 from the drill will thereupon lower the rack 328 and micro dial 360 carried thereby to the solid line position shown in FIG. 17**.

Upon start of the grinding operation, therefore, actuation of the C-5 will extend the rod 324 to a position in which the follower button 366 of the micro dial 360 engages the cam 358, shown in phantom in FIG. 17, which as indicated, is the preset condition of initial contact of the drill D with the grinding wheel. It will be seen that upon engagement of the cam 358 with the micro dial follower button 366, the limit switch LS-15 is closed by the micro dial mounting flange 325. By appropriate means, as will become apparent, the pneumatic feed cylinder C-6 may be actuated following such closure of the switch LS-15 to extend upwardly the rod 371, thereby rotating the cam 358. Since the cam is formed with a contour having a gradually reduced radius about the cam pivot point from the point of contact shown in FIG. 17, pivotable movement of the cam 358, as illustrated in FIG. 18, will allow the micro dial follower button 366 and rack 328 to be moved under the continued force of the actuated cylinder C-6, feeding the grinding wheel further toward a drill D in the machine workhead a predetermined amount which can be accurately present by prior adjustment of the stop member 372 on the lower gaged threaded end of the rod 371. Thus, with the grinding wheel feed control apparatus in the condition shown in FIGS. 17 and 18, the grinding wheel may be automatically fed to a position in initial contact with the grinding wheel for a Racon mode of operation, and then be automatically fed a further precisely controlled amount as may be necessary during the grinding process. Upon completion of the grinding operation, cylinder C-5 can be utilized to retract the rack 328, and thus the grinding wheel, to its starting position, enabling removal of the drill from the workhead.

To permit selective shifting of the pivot plate 355 from a position shown in FIG. 17 for controlling feed of the grinding wheel during the Racon mode of operation to a position for controlling grinding wheel feed during the helical mode of operation, as shown in FIG. 17*a*, a cylinder C-4 is mounted on the support 320 and has a plunger arm 375 pivotably connected to a lower corner of the pivot plate 355. The cylinder C-4 may be actuated to retract the rod 375 from an extended position shown in FIG. 17 to a retracted position shown in FIG. 17*a*, which pivots the plate 355 to a position in which the helical feed cam 358*a* is located above the helical micro dial 360*a*, and the Racon feed cam 358 is moved to a position remote from its associated micro dial 360. For sensing the pivotal position of the plate 355, limit switches LS-9 and LS-10 are mounted on the support 320 for engagement by a respective pivoted side of the plate 355.

The automatic operation of the machine for the various drill pointing modes will become more apparent upon reference to the control circuitry diagrammatically illustrated in FIG. 47. The following will first consider the automatic grinding of the radial-conventional or Racon drill point form. It will be understood that prior to the start up of any of the automatic cycles, certain set of procedures are required including (1) timing the drill D to be ground in a drill holder 20 through use of the drill loading jig 24, (2) loading the drill holder and drill in the machine workhead 15, (3) turning on the grinding wheel motor 205, workhead motor 45, and coolant and mist collector motors, by means of buttons located on the control panel 30, as shown in FIG. 46. Further setup requirements specifically for the Racon automatic operating mode includes (1) moving the rock motion lock member 305 to a lock position so as to prevent rocking movement of the rock arbor 50 and workhead 15 (2) setting the LIFT RATE, FEED RATE, and GRIND POSITION knobs under the Racon grinding mode on control panel 32 to the appropriate settings for the size drill to be ground, (3) setting the RACON COUNTER on control panel 31 to the desired number of grinding cycles to be carried during the automatic operation, (4) setting switch SW-2 on control panel 31 to RACON, and (5) setting switch SW-1 on the control panel 31 from SET-UP to SINGLE AUTO CYCLE.

Setting switch SW-2 to RACON has the effect of energizing solenoid SOL-16 of a two-positioned solenoid operated valve V2 positioning it as shown in FIG. 47 so as to allow pressure from an air supply 380 lines 381 and 382 into cylinders C-1, C-2, and C-3. Pressure in line 382 enters the head of cylinder C-1 to extend the control rod 311 causing counterclockwise rotation of the arm 312, as viewed in FIG. 15, which simultaneously causes engagement of the bell crank arm follower 250 with the Racon feed cam 240 and disengagement of the bell crank arm follower 250*a* from the helical feed cam 244. At the same time, pressure in line 382 will enter the head end of cylinder C-2 to extend its rod and bevel block 286 to lift the adjustable fulcrum 278 to engage the follower 270 with the Racon lift cam 241, and pressure enters the rod end of cylinder C-3 to retract its rod end and bevel block 286*a* lowering the fulcrum 278*a* and follower 270*a* from the helical lift cam 245. Opposite ends of cylinders C-1, C-2, and C-3 are relieved of pressure through line 384 and 385 to an exhaust muffler 386. Supply pressure in line 382 also flows through a spring return control valve V3, through line 388, and into the head side of C-4, extending the rod 375 and pivoting the grinding wheel feed control pivot plate 355 counterclockwise, as viewed in FIG. 47, to the Racon position, making switch LS-10.

Setting switch SW-1 to SINGLE AUTO CYCLE has the effect of energizing solenoid SOL-19 of a spring return solenoid valve V-1 to position it as shown in FIG. 47, which allows supply pressure through line 389 to the rod side of cylinder C-8, which retracts the rod 345 and thereby engages the grind wheel pinion 340 with the rack 328. The grinding wheel may thereupon be manually advanced by the hand wheel 25 into contact with the drill D and the Racon micro dial 360 set in contact with the Racon feed cam 358 in the manner previously described. The machine is then ready to begin the automatic Racon operating cycle.

To start the automatic Racon grinding cycle, the AUTO CYCLE START button on control panel 30 is then pushed, which energizes solenoid SOL-1 to shift the spool of control valve V-4 to the left, as viewed in FIG. 47, to allow pressure in line 389, after exceeding the setting of pressure valve PV-1, to enter line 390 and the head end of the auto feed cylinder C-5, which extends the rod 324 thereof and raises the rack 328, in turn rotating the pinion 340 and feeding the grind wheel 14 into contact with the drill D, at which point the follower button of the micro dial 360 will contact the Racon feed cam 358. Simultaneously, the mounting flange 325 of the micro dial 360 will contact limit switch LS-15 which produces a signal to (1) start the RACON COUNTER and (2) energize solenoid SOL-20 of the automatic feed valve V-5. The feed valve V-5 is a three-position solenoid operated spring centered valve, which upon energization of solenoid SOL-20 moves to the right, as viewed in FIG. 47, allowing pressure, after exceeding the value set by pressure valve PV-2, to enter line 391 and the lower head end of cylinder C-6 and extend the rod 371 against the force of an internal spring contained therein, thereby pivoting the Racon feed cam 358 until the stop member 372 engages the lower end of the cylinder C-6. The decreasing contour of the cam 358 allows further upward travel of the rod 324 of cylinder C-5, and its associated rack 328, for automatically feeding the grinding wheel 14 during the grinding operation until the rod of cylinder C-6 reaches its full preset feed position. It will be understood that during the grinding operation, the Racon feed and lift cams 240, 241 driven by the motor 45 control movement of the drill holding workhead 15 in the manner shown in FIGS. 21–27, as previously discussed. During each cycle of grinding, the RACON COUNTER is actuated from signals generated by a limit switch LS-17 which engages the counter cam 248, fixed to the cam shaft 236 for the Racon feed and lift cams 240, 241. When the RACON COUNTER counts the preset number of cycles, a terminating signal will deenergize solenoids SOL-1 and SOL-20, and shut off the power to the workhead motor 45 to complete the grinding cycle.

To automatically grind the helical drill point form, initial set-up would include (1) moving the rock motion member 305 to the lock position to lock out rocking movement of the workhead, (2) setting the LIFT RATE, FEED RATE, and GRIND POSITION KNOBS for the helical operating mode to the appropriate settings, (3) setting a CONV/HELICAL COUNTER to the desired number of grinding cycles to be carried out during the automatic operation, (4) setting switch SW-2 to CONV/HELICAL and, (5) setting switch SW-1 from SET-UP to SINGLE AUTO CYCLE.

Setting switch SW-1 to CONV/HELICAL has the effect of energizing solenoid SOL-17 to shift the spool of valve V-2 to the position left of that shown in FIG. 47 so as to reverse pressure flow through the valve. Thus, pressure supplied to cylinder C-1, C-2, and C-3 would enter through line 384 and the opposite ends of the cylinders would be exhausted through lines 382 and 385. Pressure supplied to cylinder C-1 would then enter the rod side of the cylinder causing the rod 311 to be retracted, moving the arm 312 in a downward or clockwise direction as viewed in FIG. 15. Such movement of the arm 312 has the effect of simultaneously disengaging the bell crank following 250 from the Racon feed cam 240 and engaging the bell crank follower 250*a* with the helical feed cam 244. At the same time, pressure in line 384 will enter the rod end of cylinder C-2 to retract the bevel block 286 to lower the fulcrum 278, disengaging the follower 270 from the Racon lift cam 241, and pressure in line 384 will enter the head of cylinder C-3 to extend its bevel block 286*a* lifting the adjustable fulcrum 278*a* and follower 270*a* into operative engagement with the helical lift cam 245. Thus, the compound movement of the workhead 15, which is driven from the motor 45, would thereupon be controlled by the helical lift and feed cams 244, 245. Supply pressure in line 384 also would flow through valve V-3, line 395, and into the rod end of the cylinder C-4, which retracts the rod 375 and pivots the plate 355 in a clockwise direction, as viewed in FIG. 47, to a helical grind wheel control position, making switch LS-9. In such position, the helical feed cam 358*a* carried by the plate 355 is located immediately above the helical micro dial 360*a*.

Setting switch SW-1 to SINGLE AUTO CYCLE has the effect, as previously indicated, of energizing solenoid SOL-19 of valve V-1 to position it as shown in FIG. 47, which allows supply pressure through line 389 to the rod side of cylinder C-8, which retracts the rod and engages the grinding wheel pinion 340 with the rack 328. The grinding wheel 14 may thereupon be manually advanced by the hand wheel 25 into contact with the drill held in the workhead and the helical micro dial 360*a* set in contact with the feed cam 358*a*. The machine is then ready to start the automatic operating cycle.

To start the automatic helical operating mode, the AUTO CYCLE START button is pushed which energizes solenoid SOL-1 and allows pressure, as regulated by pressure valve PV-1, to flow through the valve V-4 and line 390 into the head end of cylinder C-5 to extend the rack 328 and rotate the grinding wheel drive pinion 340, feeding the grinding wheel into contact with the drill, at which point the micro dial 360*a* contacts the helical feed cam 358*a*. Simultaneously, the transverse flange 325 of the micro dial mounting plate makes contact with limit switch LS-16 to produce a signal to (1) start the CONV/HELICAL counter and (2) energize solenoid SOL-21 which moves the spool of valve V-5 to the left, as viewed in FIG. 47, permitting pressure, as regulated by pressure valve PV-2, to flow into line 396 and the head end of feed cylinder C-7, which extends the rod of cylinder C-7, rotating cam 358*a* and allowing the rack 328 carried by cylinder C-5 to feed the grinding wheel a predetermined further amount, as established by the stop member 372*a* of the cylinder C-7. During the grinding operation, the helical feed and lift cams 244, 245 driven by the motor 45 controlled movement of the drill holding workhead 15 in the manner illustrated in FIGS. 28–34 to grind the helical form of drill point. When the CONV/HELICAL counter, which also counts rotation of the cam shaft 236 by means of the counter cam 248 and limit switch LS-17, reaches its pre-set cycle count, the terminating signal of the CONV/HELICAL counter de-energizes solenoid SOL-1, energizes solenoid SOL-2, de-energizes solenoid SOL-21, and sets off the power to the workhead motor to complete the cycle.

In carrying out the invention, the foregoing control circuitry is further adapted to automatically combine the Racon and helical operating modes to grind a helical drill point form. To this end, set-up for automatic grinding of the helicon drill point involves setting upon the Racon operating mode for grinding the appropriate curved contour of the drill point surface at its outer periphery where it meets a shank, and also setting up the helical operating mode for grinding the helical or S shaped crowned drill point end. Specifically, set-up would include (1) moving the rock motion lock member 305 to a lock position so as to lock out rock movement of the workhead, (2) setting the LIFT RATE, FEED RATE, and GRIND POSITION KNOBS for the operating Racon mode to the appropriate settings for the size drill to be ground, (3) setting the LIFT RATE, FEED RATE, and GRIND POSITION KNOBS for the helical operation mode to the appropriate settings, (4) setting the RACON COUNTER to the desired number of operating cycles to be carried out during that mode of operation, (5) setting the CONV/HELICAL COUNTER to the desired number of grinding cycles to be carried out in that mode of operation, (6) setting switch SW-2 to RACON, which energizes solenoid SOL-16 and extends the rod of cylinder C-4 pivoting plate 355 to the Racon grinding wheel control position, thereby permitting the grinding wheel 14 to be manually advanced into contact with the drill and the Racon micro dial 360 set in a manner previously indicated, (7) then setting switch SW-2 to CONV/HELICAL, which energizes solenoid SOL-17 so as to reverse the pressure flow through valve V-2 and into cylinder C-4, pivoting plate 355 to the helical grinding wheel control position, thereby permitting the grinding wheel to be manually advanced into contact with the drill and the helical micro dial 360*a* set, (8) and finally setting switch SW-1 from SET-UP TO DUAL AUTO CYCLE which (a) again energizes solenoid SOL-16 causing the pivot plate 355 to be pivoted back to the Racon grinding wheel control position, and the Racon feed and lift cams 240, 241 to be engaged by their respective cam followers 250, 270, while rendering inoperative the helical feed and lift cams 244, 245 and (b) energizes solenoid SOL-19 causing the grinding wheel drive pinion 340 to engage the rack 328. The machine is then ready for the automatic cycle.

To start the automatic grinding of the helicon drill point form, the DUAL AUTO start button is pushed, which energizes solenoid SOL-1, moving the spool thereof to the left as viewed in FIG. 47, so as to permit pressure flow, as regulated by pressure valve PV-1, to the head end of cylinder C-5 which extends the rod thereof until the micro dial 360 contacts the Racon cam 358 making limit switch LS-15. Closing the limit switch LS-15 produces a signal to (1) start the RACON COUNTER and (2) energize solenoid SOL-20 of the automatic feed valve V-5 which permits pressure flow to cylinder C-6, which in turn pivots the Racon feed cam 358, allowing a further limited feed of the grinding wheel during the grinding operation, as preset by the gaged stop member 372 of the cylinder C-6. During the grinding operation, the Racon feed and lift cams 240, 241 control movement of the drill in the manner shown in FIGS. 21–27, as previously discussed, to form a curved contour at the outer perimeter of the drill point where it meets the shank, as further depicted in FIGS. 42 and 43. When the RACON COUNTER reaches the preset number of cycles, the terminating signal will de-energize solenoid SOL-1, energize solenoid SOL-2, de-energize solenoid SOL-16, energize solenoid SOL-17, and de-energize solenoid SOL-20.

Figure 44:
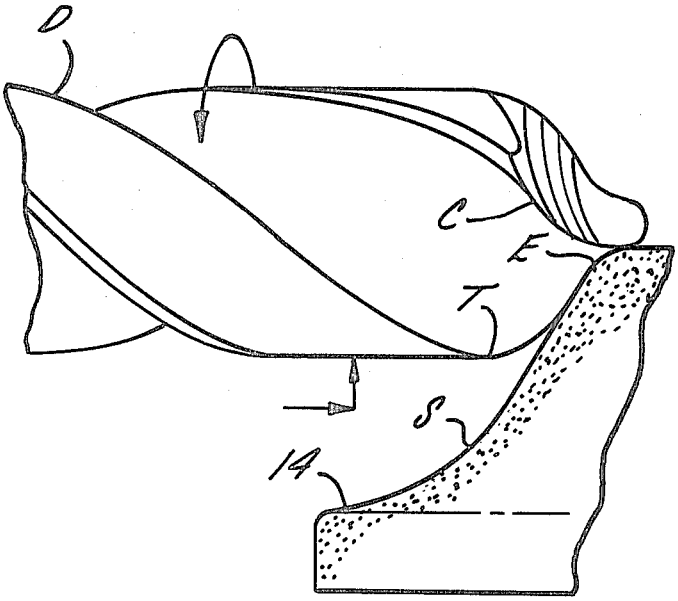
Figure 45:
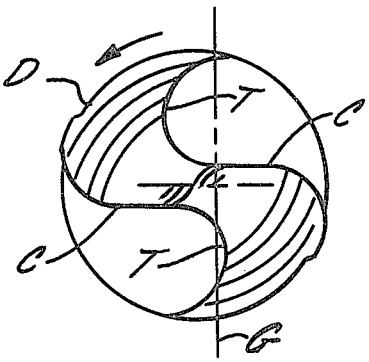

Enerigization of solenoid SOL-17 will thereupon reverse the flow through valve V-2 permitting a pressure flow into line 384 which simultaneously disengages the Racon feed and lift cam 240, 241 and renders the helical feed and lift cams 244, 245 operable to control workhead movement. Pressure in line 384 communicates through line 395 to cylinder C-4 to pivot the grinding wheel feed control plate 355 to the right, as viewed in FIG. 47, to the helical control position making limit switch LS-9. Closing of limit switch LS-9 automatically turns on power to the workhead motor 45, energizes solenoid SOL-1 which permits the grinding wheel to be advanced into contact with the drill making and limit switch LS-16, which in turn starts the CONV/HELICAL COUNTER and energizes solenoid SOL-21 to cause cylinder C-7 to feed the grinding wheel a further predetermined amount during the grinding operation. The drill at this time is moved under the control of the helical feed and lift cams 244, 245 as illustrated in previously described FIGS. 28–34, which has the effect of forming a crowned generally helical or S shaped tip on the drill D, which in the previous operation was formed with a curved contour at the outer perimeter of the shank, as shown in FIGS. 44 and 45. When the CONV/HELICAL COUNTER reaches the preset number of cycles, a terminating signal of the counter de-energizes the solenoid SOL-1, de-energizes solenoid SOL-17, energizes solenoid SOL-16, and de-energizes SOL-21, and shuts off power to the workhead motor to complete the cycle. It will be seen that the finished drill point, as illustrated in FIGS. 44 and 45, has both a crowned S or helical shaped point and a curved contour at the outer perimeter of the shank, such point being commonly referred to as the helicon or the combination helical and radial-conventional drill point. Thus, it can be seen that the grinding machine 10 is adapted to automatically grind either the Racon, helical, or helicon drill point forms in a single set-up. It will be understood that the machine is also adapted for automatic grinding of the conventional or conical drill point formed. In such case, the machine would be operated in the identical manner as for the helical drill point, except that the workhead would be unlocked to permit rocking movement with the rock arbor.

As a further feature of the invention, the machine is adapted to permit selected manual grinding of any of foregoing drill point forms. To that end, the switch SW-1 can be set to the MANUAL, which has the effect of energizing solenoid SOL-18 of control valve V-3 to block pressure in line 395 from entering cylinder C-4. Moreover, with such setting of switch SW-1, solenoid SOL-19 remains unenergized, causing the spring return valve V-1 to force the valve spool to the right, as viewed in FIG. 47, such that pressure from the supply 380 is directed to the head end of cylinder C-8, extending the rod 345 thereof, and causing the grinding wheel drive pinion 340 to be moved out of engagement with the rack 328.

With the automatic grinding wheel feed apparatus thereby rendered inoperative, the switch SW-2 can be set to the desired drill point form to be ground. For example, by setting SW-2 to RACON, solenoid SOL-16 is energized which has the effect of causing the Racon feed and lift cams to be engaged by their respective follower mechanisms while the helical feed and lift cams are disengaged, as previously indicated. The drill carrying workhead 15 will thereby be moved under the control of the Racon feed and lift cams 240, 241 with the grinding wheel being appropriately positioned manually. Likewise, for forming a helical drill point, the switch SW-2 is merely switched to CONV/HELICAL which de-energizes selenoid 16 and energizes selenoid 17, rendering the helical and feed cams operative, while rendering the Racon feed and lift cams inoperative. The same setting is utilized for forming the conventional drill point, as previously indicated, except the workhead is unlocked for rocking movement imparted by rock cam 246.

Figure 42:
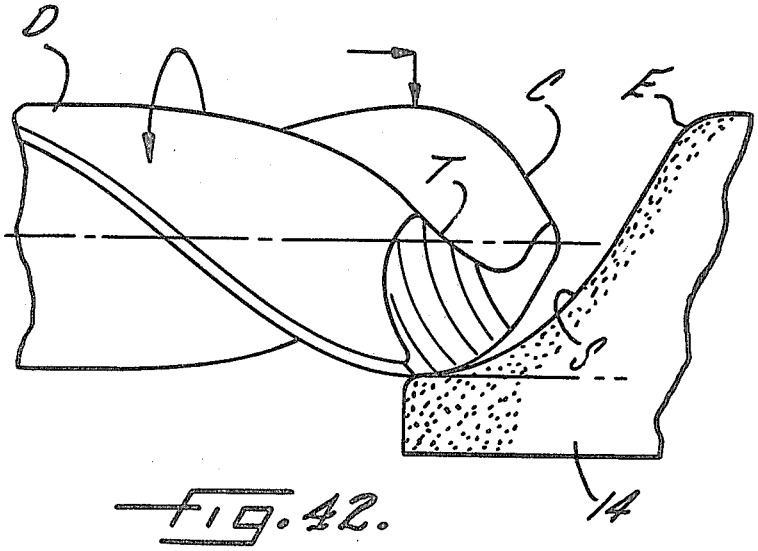
Figure 43:
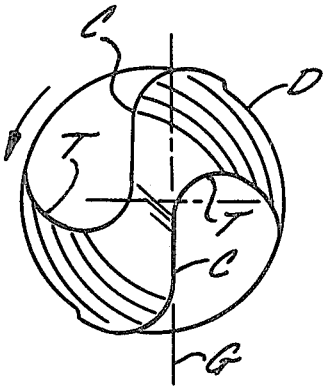

It will be understood that the helicon drill point form could similarly be ground in the manual mode of operation. In such case, the Racon manual mode of operation is first carried out, with the switch SW-2 set on Racon, which like in the automatic mode, will form the curved contour at the outer periphery of the point, as illustrated in FIGS. 42 and 43. Upon completion of that grinding mode, the switch SW-2 is set to CONV/HELICAL whereupon the helical drill tip is then formed on the end of drill, as shown in FIGS. 44 and 45. As in the case of the automatic mode of operation, the Bickford drill point may be ground without removal from the workhead, and without any further set-up requirements, other than changing the setting of switch SW-2 from RACON to CONV/HELICAL and the normal manual positioning of the grinding wheel.

From the foregoing, it can be seen that the grinding machine of the present invention is adapted for automatic and efficient grinding the helicon type drill point form, without the need for multiple set-ups or successive operating stations, as has been heretofore customary. The drill point grinding machine also is selectively operable to readily grind the conical, helical, and Racon drill points, as well as the heicon drill point, without significant interruptions in the productive operation of the machine for change-over purposes. Finally, it can be seen that the foregoing drill pointing machine has still further versatility by virtue of being able to accommodate a relatively large range of drill sizes.

I claim as my invention:

1. A drill point grinding machine comprising:

a frame, a rotary grinding wheel mounted on said frame and having a grinding surface, a workhead for rotatably supporting the shank of a drill to be ground, means for rotating a drill supported in said workhead, means mounting said workhead for movement relative to said frame and grinding wheel, and means for moving said workhead while the drill is rotated therein such that following a single set-up of the machine the drill is automatically and successively moved in (1) a first predetermined cyclic path of contact with said grinding surface for grinding the point of said drill with land surfaces which meet the drill shank with a curved contour, and (2) a second predetermined cyclic path of contact with said grinding wheel for grinding the point of said drill with a forwardmost raised helical shaped tip.

2. The drill pointing machine of claim 1 including means mounting said grinding wheel for movement toward and away from said workhead, and means for automatically feeding said grinding wheel toward said workhead a predetermined amount during a grinding operation.

3. The drill point grinding machine of claim 1 including means mounting said grinding wheel for movement toward and away from said workhead, means for automatically positioning said grinding wheel to a location in close proximity to a drill supported by said workhead prior to a grinding operation, and means for automatically feeding said grinding wheel towards said workhead a predetermined additional amount during said grinding.

4. A drill pointing machine comprising:

a frame, a rotary grinding wheel mounted on said frame and having a grinding surface, a workhead for rotatably supporting the shank of a drill to be ground, means for rotating a drill supported in said workhead, means mounting said workhead for movement relative to said frame and grinding wheel, first means for moving said workhead in a first predetermined cyclic path such that a drill supported therein undergoes cyclic engagement with said grinding surface whereby the drill is ground with a first drill point form having land surfaces which meet the shank of the drill with a curved contour, second means for moving said workhead in a second predetermined cyclic path such that the end of a drill supported therein undergoes cyclic engagement with said grinding surface whereby the drill is ground with a second drill point form having a raised forwardmost tip of helical shape, and control means for selectively rendering operable either of said first and second workhead moving means following a single set-up of the machine.

5. The drill point grinding machine of claim 4 in which said control means is selectively operable to successively operate said first and second workhead moving means to grind on a drill supported therein a third drill point form having land surfaces with a curved contour at their outer periphery and a forwardmost tip having a raised helical shape.

6. The drill point grinding machine of claim 4 including means mounting said grinding wheel for movement toward and away from said workhead, means for automatically positioning said grinding wheel to a location in close proximity to a drill supported by said workhead prior to grinding of said drill, and means for automatically feeding said grinding wheel towards said workhead a predetermined additional amount during said grinding.

7. A drill pointing machine of claim 6 in which said grinding wheel positioning means includes a first fluid actuated cylinder means, means responsive to actuation of said first cylinder means for moving said grinding wheel toward said workhead, selectively adjustable stop means for interrupting the action of said first cylinder means when said grinding wheel reaches said predetermined position, and said grinding wheel feeding means includes means for allowing the action of said first cylinder means to further advance said grinding wheel a predetermined amount in response to said grinding wheel reaching said position in close proximity to said drill.

8. The drill pointing machine of claim 7 in which said grinding wheel feeding means includes a second fluid actuated cylinder means, means responsive to actuation of said second cylinder means for feeding said grinding wheel a predetermined amount when said workhead moves said drill in the first cyclic path of grinding wheel contacting movement, third fluid actuated cylinder means, and means responsive to actuation of said third cylinder means for feeding said grinding wheel a predetermined amount when said workhead moves said drill in the second cyclic path of grinding wheel contacting movement.

9. The drill pointing machine of claim 8 in which said cylinder stop means includes first cam means for limiting the operation of said first cylinder means and establishing the position of said workhead prior to a grinding operation in which said workhead is moved in said first cyclic path, and second cam means for limiting the operation of said first cylinder means and establishing the position of said workhead prior to a grinding operation in which said workhead is moved in said second cyclic path.

10. The drill pointing machine of claim 9 in which said grinding wheel feeding means includes a fourth fluid actuated cylinder means operable to rotate said first cam means for allowing feed movement of said grinding wheel under the action of said first cylinder means during movement of said workhead in said first cyclic path, and fifth fluid actuated means operable to rotate said second cam means for allowing feed movement of said grinding wheel under the action of said first cylinder means during movement of said workhead in said second cyclic path of grinding.

11. The drill pointing machine of claim 10 in which said first cylinder means includes a cylinder rod, and said stop means includes a first adjustable follower means carried by said rod for engaging said first cam means prior to a grinding operation in which said workhead is moved in said first cyclic path, and second adjustable follower means carried by said rod for engaging said second cam means prior to a grinding operation in which said workhead is moved in said second cyclic path.

12. The drill pointing machine of claim 11 including means for simultaneously moving said first and second cam means from a first position in which said first cam means is disposed for engagement by said first adjustable follower means and said second cam means is located remote from said second adjustable follower means to a second position in which said second cam means is disposed for engagement by said second follower means and said first cam means is located remote from said first follower means.

13. The drill pointing machine of claim 12 in which said means for moving said cam means is a pivot plate which rotatably supports said first and second cam means, means pivotably supporting said plate for movement about a first pivot axis, and means for selectively pivoting said plate between said first and second cam means locating positions.

14. The drill pointing machine of claim 13 in which said means for positioning and feeding said grinding wheel includes a rack mounted on said rod of said first cylinder means for movement with said rod, a pinion means for selectively engaging said pinion with said rack such that movement of said rack will rotate said pinion, and means responsive to rotation of said pinion for moving said grinding wheel.

15. The drill pointing machine of claim 14 in which said first cylinder means is mounted on said pivot plate, and said pivot plate is pivotable about a second pivot axis for permitting proper engagement between said pinion and rack.

16. A drill pointing machine comprising:

a frame, a rotary grinding wheel mounted on said frame and having a grinding surface, a workhead for rotatably supporting a drill to be ground, workhead drive means for rotating a drill supported in the workhead, means mounting said workhead for movement relative to said frame and said grinding wheel, first selectively operable means driven from said workhead drive means for oscillating said workhead about and vertically reciprocting said workhead along a given axis of said machine for moving a drill rotatably driven therein in a first predetermined cyclic path of contact with said grinding wheel for grinding thereon a first drill point form, and second selectively operable means driven from said workhead drive means for oscillating said workhead about and vertically reciprocating said workhead along said machine axis for moving a drill rotatably driven therein in a second predetermined cyclic path of contact with said grinding wheel for grinding thereon a second distinct drill point form, selectively operable means for rocking said workhead about a rocking axis transverse to said given machine axis and the axis of the drill for varying the angle between the drill axis and a plane normal to said machine axis during movement of said workhead in either of said first and second cyclic paths, and control means for selectively rendering operable either of said first and second workhead moving means following a single set-up of the machine.

17. The drill pointing machine of claim 16 including means for selectively inactivating said rocking means.

18. The drill pointing machine of claim 16 including means mounting said grinding wheel for movement toward and away from said workhead, and means for automatically feeding said grinding wheel toward said workhead a predetermined amount during a grinding operation.

19. A drill pointing machine comprising:

a frame, a rotary grinding wheel mounted on said frame and having a grinding surface, a workhead for rotatably supporting the shank of a drill to be ground, means for rotatably driving a drill supported in the workhead;

means mounting said workhead for movement relative to said frame and said grinding wheel, first means for moving said workhead such that a drill supported and rotatably driven therein is moved in a first predetermined cyclic path defined by the formula $$\frac{x^2}{a^2} + \frac{y^2}{b^2} + S\left(\frac{z^2}{c^2}\right) = 1$$

wherein x, y, and z represent three coordinate reference axes of the machine, a, b, and c represent the coefficient of movement of the drill carried by said workhead relative to said axes, said S equals +1, whereby the drill undergoes cyclic contact with said grinding surface to grind a first drill point form, second means for moving said workhead such that a drill supported and rotatably driven therein is moved in a second predetermined cyclic path defined by said formula, wherein x, y, and z represent said reference axes, a, b, and c represent the coefficient of movement of the drill carried by said workhead relative to said axes, and S equals −1, whereby the drill undergoes cyclic contact with said grinding surface to grind a second distinct drill point form, and control means for selectively rendering operable either of said first and second workhead moving means following a single set-up of the machine.

20. The drill pointing machine of claim 18 in which said control means is selectively operable to successively operate said first and second workhead moving means to grind a third distinct drill point form on a drill supported therein.

21. The drill pointing machine of claim 19 including means mounting said grinding wheel for movement toward and away from said workhead, means for automatically positioning said grinding wheel to a location in close proximity to a drill supported by said workhead prior to grinding of said drill, and means for automatically feeding said grinding wheel towards said workhead a predetermined additional amount during said grinding.

22. A drill pointing machine comprising:

a frame, a rotary grinding wheel mounted on said frame and having a grinding surface, a workhead for rotatably supporting a drill to be ground, workhead drive means for rotating a drill supported in the workhead, means mounting said workhead for movement relative to said frame and said grinding wheel, first means for moving said workhead along an axis of said machine for lifting and lowering said workhead relative to said grinding wheel, second means for moving said workhead in a plane perpendicular to said machine axis for feeding and withdrawing said workhead from said grinding wheel, control means for selectively rendering operative said first and second workhead moving means to cause a drill supported in said workhead to undergo compound cyclic movement into engagement with said grinding surface for grinding a first drill point form thereon, third means for moving said workhead along said machine axis for lifting and lowering said workhead relative to said grinding wheel, fourth means for moving said workhead in a plane perpendicular to said machine axis for feeding and withdrawing said workhead from said grinding wheel, and control means for selectively rendering operative said third and fourth workhead moving means to cause a drill supported in said workhead to undergo second compound cyclic movement into engagement with said grinding surface for grinding a second drill point form.

23. The drill pointing machine of claim 22 in which said control means is selectively operable to successively operate first said first and second workhead moving means and then said third and fourth workhead moving means to form a third distinct drill point form on a drill supported in said workhead.

24. The drill pointing machine of claim 22 in which said first and second workhead moving means including first and second cam means rotatably driven by said workhead drive means, first and second means responsive to rotation of said first and second cam means for imparting said first compound cyclic movement, said third and fourth workhead moving means including third and fourth cam means rotatably driven by said workhead drive means, and third and fourth means responsive to rotation of said third and fourth cam means for imparting said second compound cyclic movement.

25. The drill pointing machine of claim 24 in which said control means is operable to selectively render said first and second cam responsive means inoperative while said first and second cam means continue to be driven by said workhead drive means and to selectively render said third and fourth cam responsive means inoperative while said third and fourth cam means continue to be driven by said workhead drive means.

26. The drill pointing machine of claim 25 in which said control means is selectively operative for rendering said first and second cam responsive means inoperative while simultaneously rendering operative said third and fourth cam responsive means and for rendering inoperative said third and fourth cam responsive means while simultaneously rendering operative first and second cam responsive means.

27. A drill pointing machine comprising;

a frame, a rotary grinding wheel mounted on said frame and having a grinding surface, a workhead for rotatably supporting a drill to be ground, workhead drive means for rotating a drill supported in the workhead, means mounting said workhead for movement relative to said frame and said guiding wheel, first feed and lift cams rotatably driven by said workhead drive means, first selectively operable workhead moving means responsive to rotation of said first feed and lift cams for respectively (1) feeding and withdrawing said workhead relative to said grinding wheel surface and (2) lifting and lowering said workhead relative to said grinding surface, whereby a drill supported in said workhead undergoes a first compound cyclic movement of engagement with said grinding surface, second feed and cam means rotatably driven by said workhead drive means, second selectively operable workhead moving means responsive to rotation of said second feed and lift cams for respectively (1) feeding and withdrawing said workhead relative to said grinding wheel surface and (2) lifting and lowering said workhead relative to said grinding wheel surface, whereby a drill supported in said workhead undergoes a second compound cyclic movement of engagement with said grinding surface, and control means for selectively rendering one of said cam responsive workhead moving means operable.

28. The drill pointing machine of claim 27 in which said control means is selectively operable to successively operate said first and second workhead moving means.

29. The drill pointing machine of claim 27 in which said control means selectively renders one of said cam responsive workhead moving means operable while simultaneously rendering the other of said cam responsive workhead moving means inoperative.

30. The drill pointing machine of claim 29 in which said first cam responsive means comprises first and second cam followers respectively engageable with said first feed and lift cams, said second cam responsive means comprises second and third cam followers respectively engagable with said second feed and lift cams, and said control means is selectively operable to engage said first and second cam followers with said respective first feed and lift cams while disengaging said third and fourth cam followers from said second feed and lift cams.

31. The drill pointing machine of claim 30 in which said cam followers each include a pivot arm and an adjustable fulcrum means associated with the pivot arm, said adjustable fulcrum means for each cam follower pivot arm being selectively positionable to permit adjustment of the respective movement imparted therefrom to the workhead.

32. The drill pointing machine of claim 31 including means for moving the fulcrum of at least some of said followers to a position such that the respective follower is selectively disengaged from its respective cam.

33. The drill pointing machine of claim 32 including means for selectively moving the fulcrums of said lift cam followers to a position such that the follower can be selectively disengaged from its respective cam.

34. The drill pointing machine of claim 33 including means for moving the fulcrum of one of said lift cams to a follower disengaging position while simultaneously moving the fulcrum of the other said lift cam to a cam follower engaging position.

35. The drill pointing machine of claim 31 including a rotatable cam follower shaft, means eccentrically mounting at least some of said cam followers on said shaft, and means for selectively rotating said cam follower shaft for engaging and disengaging the followers mounted thereon with their respective cams.

36. The drill pointing machine of claims 35 in which the followers for said feed cams are mounted on said cam follower shaft, and in which rotation of said shaft causes engagement of one of said cam followers with its respective feed cam while disengaging the other of said followers from its respective feed cam.

37. A drill pointing machine comprising;

a frame, a rotary grinding wheel having a grinding surface and being mounted on said frame for movement toward and away from said workhead, a workhead for rotatably supporting a drill to be ground, means for rotating a drill supported in said workhead, means mounting said workhead for movement relative to said frame and grinding wheel, means for automatically moving said workhead while the drill is rotated therein in a predetermined cyclic path of contact with respect to said grinding surface, means for automatically positioning said grinding wheel to a location in close proximity to a drill supported by said workhead prior to start up of a grinding operation, and means for automatically feeding said grinding wheel towards said workhead a controlled predetermined further amount during said grinding operation.

38. A drill pointing machine of claim 36 in which said automatic grinding wheel positioning means includes a fluid actuated cylinder means, means responsive to actuation of said cylinder means for moving said grinding wheel toward said workhead, first selectively adjustable stop means for interrupting the action of cylinder means when said cylinder reaches said predetermined position, and said further grinding wheel feeding means includes means for allowing the action of said cylinder means to further advance said grinding wheel a predetermined amount in response to said grinding wheel reaching said position in close proximity to said drill.

39. The drill pointing machine of claim 37 in which said grinding wheel feeding means includes a second fluid actuated cylinder means, and means responsive to actuation of said second cylinder means for feeding said grinding wheel said further amount.

40. The drill pointing machine of claim 38 including second selectively adjustable stop means for controlling the operation of said second cylinder means and limiting said further grinding wheel feeding movement to a predetermined amount.

41. The drill pointing machine of claim 39 in which said first stop means includes a rotatable cam, and said second fluid actuated means is operable to rotate said cam to allow further movement of said grinding wheel under the action of said first cylinder means.

42. The drill pointing machine of claim 38 in which said first cylinder means includes a cylinder rod, and said first stop means includes adjustable means carried by said rod for engaging said cam when said grinding wheel reaches said predetermined position.

43. The drill pointing machine of claim 41 in which said adjustable rod supported stop means is a micro dial.

44. In a drill pointing machine for grinding points of drills held in drill holders having spring biased drill engaging collets comprising a frame, a rotary grinding wheel mounted on said frame and having a grinding surface, a workhead having a rotor for receiving a drill holder, means for rotating said workhead rotor, means for moving said workhead in a predetermined cyclic path such that a drill carried therein undergoes cyclic engagement with said grinding surface, said rotor having means for receiving and locating drill holders of common diameter in predetermined axial and angular relation to said workload, a loading jig for locating a drill in a drill holder in predetermined angular and axial position, said loading jig including means for supporting a drill holder of relatively short axial length and for selectively relieving the spring biasing force of the drill engaging collets thereof to permit loading therein of relatively a small size drill, said loading jig including means for supporting a relatively long drill holder and for selectively relieving the spring biasing force of the drill engaging collets thereof to permit loading therein of a relatively larger size drill, said drill holder support means of said jig including a cradle, an abuttment means formed on said cradle for retaining said relatively long length drill holder against axial movement while the collet biasing force of such drill holder is relieved, selectively positionable abuttment means positioned for retaining said relatively short length drill holder against axial movement while the collet biasing force of such drill holder is relieved, and said selectively positionable abuttment means being locatable to an inoperative position when said relatively long length tool holder is supported on said cradle.

45. In a drill point grinding machine comprising a cabinet having an upper closure, a grinding wheel having a grinding surface and being mounted within said upper closure, a workhead for supporting a drill to be ground with the end thereof in close proximity to said grinding surface, means for moving the workhead such that a drill carried thereby is moved in a predetermined cyclic path of contact with said grinding surface, means for selectively directing coolant on said grinding surface during grinding, said coolant directing means including a handle located on the outside of said closure, a coolant line support rod located within said closure, and a coolant line secured to said support rod within said closure, said rod being selectively positionable in response to movement of said handle for locating said coolant line to a desired orientation with respect to said grinding wheel to permit relatively precise selection of the location on said grinding surface onto which coolant is to be directed, a bearing plate interposed between said handle and said closure, said handle threadably engaging said rod, said handle being rotatable in a rod disengaging direction to permit said selective positioning of said rod and the coolant line secured thereto, and said handle being rotatable in a rod engaging direction to engage said handle and bearing plate to secure the handle and rod at a desired coolant line location position.

46. In the drill pointing machine of claim 45 including bearing means mounted in said closure for pivotably supporting said rod, and said bearing plate interposed between said handle and said closure is movable.

47. In the drill pointing machine of claim 46 in which the lower end of said handle is spherically shaped and an upper side of said bearing plate is formd with a spherical recess for receiving said handle end.

48. In the drill pointing machine of claim 44 in which said means for relieving the collet spring biasing force of said relatively short length tool holders is a first pivotable yolk with means engaging the drill holder, a handle operatively coupled to said first yolk for selectively moving said first yolk to a position relieving the collet biasing force of a relatively short length drill holder supported on said cradle, and said means for relieving the collet biasing force of said relatively long length drill holders includes a second yolk having means for engaging a relatively long length tool holder supported by said cradle, and means operatively coupling said second yolk to said handle such that selective movement of said handle pivots said second yolk to a position for relieving the collet biasing force of a relatively long length tool holder supported on said cradle.

49. In the drill pointing machine of claim 48 including a second pivot arm moveable from an inoperative position to an operative position in response to movement of said handle, timing means mounted on said second pivot arm for establishing the angular position of a drill in a drill holder positioned on said cradle, and said timing means being mounted on an elongated mounting shaft that is selectively positionable relative to said second pivot arm for establishing the proper axial position of a drill in a drill holder positioned in said cradle when said second pivot arm is in its operative position.

50. A drill pointing machine comprising:

a frame, a rotary grinding wheel mounted on said frame and having a grinding surface, a workhead for rotatably supporting a drill to be ground, workhead drive means for rotating a drill supported in the workhead, means mounting said workhead for movement relative to said frame and said grinding wheel, first selectively operable means driven from said workhead drive means for oscillating said workhead about and vertically reciprocating said workhead along a given axis of said machine for moving a drill rotatably driven therein in a first predetermined cyclic path of contact with said grinding wheel for grinding thereon a first drill point form, and second selectively operable means drive from said workhead drive means for oscillating said workhead about and vertically reciprocating said workhead along said machine axis for moving a drill rotatably driven therein in a second predetermined cyclic path of contact with said grinding wheel for grinding thereon a second distinct drill point form, control means for selectively rendering operable either of said first and second workhead moving means following a single set-up of the machine, and said control means being selectively operable to successively operate said first and second workhead moving means to form a third distinct drill point on a drill supported therein.

* * * * *

UNITED STATES PATENT AND TRADEMARK OFFICE

CERTIFICATE OF CORRECTION

PATENT NO. : 4,365,444

DATED : December 28, 1982

INVENTOR(S) : JOHN C. CHWAE

It is certified that error appears in the above—identified patent and that said Letters Patent is hereby corrected as shown below:

Column 21, line 48, after "380" insert -- through --.

Column 23, line 1, change "SW-1" to -- SW-2 --.

Column 31, line 52, claim 27, change "guiding" to -- grinding --.

Column 33, line 43, claim 42, change "38" to -- 40 --.

Signed and Sealed this

Fifth Day of April 1983

[SEAL]

Attest:

GERALD J. MOSSINGHOFF

Attesting Officer

Commissioner of Patents and Trademarks